US009371656B2

(12) United States Patent
Zimmer et al.

(10) Patent No.: US 9,371,656 B2
(45) Date of Patent: Jun. 21, 2016

(54) TILE SPACER DISPENSERS

(71) Applicants: David J. Zimmer, Deephaven, MN (US); Nancy L. Strickland, Deephaven, MN (US)

(72) Inventors: David J. Zimmer, Deephaven, MN (US); Nancy L. Strickland, Deephaven, MN (US)

( * ) Notice: Subject to any disclaimer, the term of this patent is extended or adjusted under 35 U.S.C. 154(b) by 0 days.

(21) Appl. No.: 14/739,092

(22) Filed: Jun. 15, 2015

(65) Prior Publication Data

US 2015/0360847 A1 Dec. 17, 2015

Related U.S. Application Data

(60) Provisional application No. 62/013,146, filed on Jun. 17, 2014.

(51) Int. Cl.
*B65H 1/00* (2006.01)
*E04F 21/00* (2006.01)

(52) U.S. Cl.
CPC ..... *E04F 21/0092* (2013.01)

(58) Field of Classification Search
CPC ..... E04F 21/0092
USPC ..... 221/198, 228, 229, 7, 2, 267
See application file for complete search history.

(56) References Cited

U.S. PATENT DOCUMENTS 3,047,192 A 7/1962 Sykes
3,119,521 A * 1/1964 Taylor ..... G07D 1/00 221/287
3,244,317 A 4/1966 Raybin
5,230,440 A * 7/1993 Kurokawa ..... B65D 83/0418 221/198
5,697,521 A 12/1997 Dixon
6,273,315 B1 * 8/2001 McGuinness ..... B25C 5/1693 206/445
6,425,495 B1 7/2002 Senda et al.
6,659,326 B2 * 12/2003 Huang ..... B25C 7/00 227/119
6,908,022 B2 * 6/2005 Schmitz ..... B25C 5/1693 227/119
6,918,523 B1 * 7/2005 Chou ..... B25C 5/1693 227/119
7,698,831 B2 * 4/2010 Higgs ..... E04F 21/0092 15/105.5
8,205,348 B2 6/2012 Baros et al.
8,523,011 B2 * 9/2013 Haas ..... B65D 83/0418 206/540

(Continued)

FOREIGN PATENT DOCUMENTS

AU WO 2013023236 A1 * 2/2013 ..... E04F 21/0092
GB 2362154 11/2001
GB 2362154 A * 11/2001 ..... E04F 21/20

(Continued)

OTHER PUBLICATIONS

Copenheaver, Blain, Authorized Officer, Invitation to Pay Fees, International Application No. PCT/US2015/036001, mailed Aug. 7, 2015, 2 pages.

(Continued)

*Primary Examiner* — Rakesh Kumar
(74) *Attorney, Agent, or Firm* — Krenz Patent Law, LLC

(57) ABSTRACT

In one implementation, a handheld device for placing tile spacers includes a body that is sized and shaped for a user to hold; a cartridge enclosed within the body that stores a plurality of tile spacers; an input mechanism affixed to the body that is moveable based on application of force by the user; an opening in the body that is sized and shaped for tile spacers; and a dispensing mechanism contained within the body that, in response to an application of force to the input mechanism by the user, causes a particular tile spacer from the plurality of tile spacers to be moved from the cartridge and out of the opening.

18 Claims, 15 Drawing Sheets

(56) References Cited

U.S. PATENT DOCUMENTS

| | | | | |
|---|---|---|---|---|
| 2009/0032565 | A1* | 2/2009 | McGuinness | B25C 5/1693 227/18 |
| 2009/0235548 | A1 | 9/2009 | Higgs et al. | |

FOREIGN PATENT DOCUMENTS

| | | | | |
|---|---|---|---|---|
| IT | WO 2009022359 | A1 * | 2/2009 | E04F 21/0092 |
| WO | 2013023236 | A1 | 2/2013 | |

OTHER PUBLICATIONS

Copenheaver, Blaine, Authorized Officer, ISA/US, Written Opinion, International Application No. PCT/US2015/036001,dated Oct. 29, 2015, 6 pages.

Copenheaver, Blaine, Authorized Officer ISA/US, International Search Report for International Application No. PCT/US2015/036001, mailed Oct. 28, 2015, 5 pages.

* cited by examiner 100
106
116b
116a
112
108
114
110
104

100
106
116b
116a
120
118
122
124
108
128
102
110
104

100
106
116b
116a
120
118
122
124
108
128
102
110
104

100
118
116b
116a
122
124
120
108
128
102
110
104

100
118
116b
122
116a
124
120
108
128
102
110
104

200
210
212
204
202
208a
208b
206

224
222
214
220
218
216

228
226

232
230

234

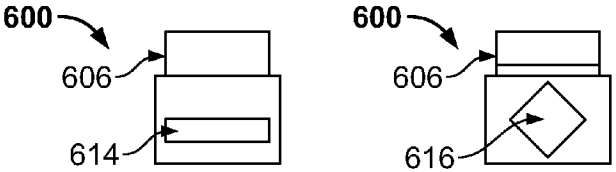
FIG. 6C
FIG. 6B
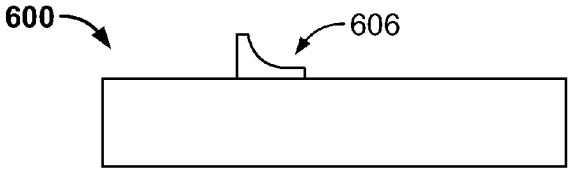
FIG. 6D
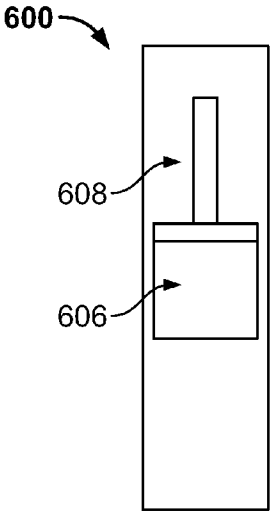
FIG. 6E
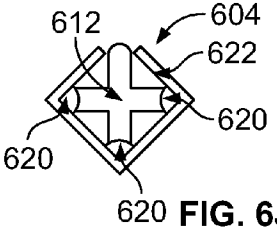
FIG. 6J
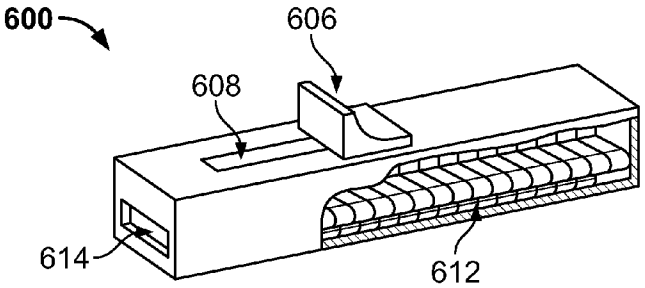
FIG. 6A
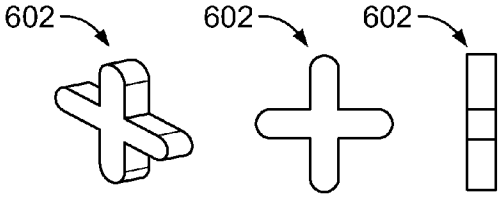
FIG. 6H
FIG. 6G
FIG. 6F
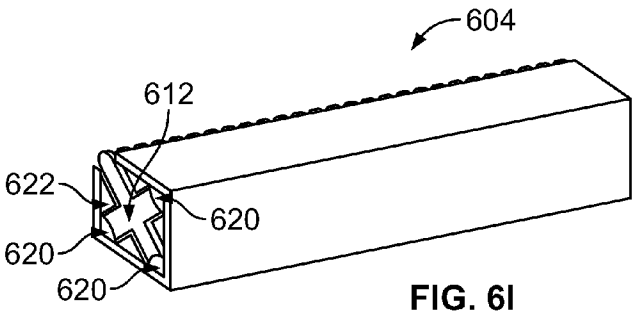
FIG. 6I 800
802
804
806
808
810a
812a
814a
816
818a
818b
820

810b
812b
814b
822

TILE SPACER DISPENSERS

CROSS-REFERENCE TO RELATED APPLICATIONS

This application claims the benefit of U.S. Provisional Application No. 62/013,146, entitled "TILE SPACER DISPENSERS," which was filed on Jun. 17, 2014, the entire contents of which are incorporated by reference herein.

TECHNICAL FIELD

This document generally describes technology for dispensing tile spacers, such as handheld devices to dispense tile spacers.

BACKGROUND

Tile spacers are objects that are sized and shaped to be placed between tiles as they are being installed to provide for near uniform spacing between the tiles. Tile spacers can come in a variety of shapes, such as 'X' and 'T' shapes, and a variety of sizes, such as 1/16", 1/8", 3/16", and 1/4". Tile spacers can additionally be made out of a variety of materials, such as plastic, rubber, metal, or any combination or compound thereof.

Tile spacers have traditionally been installed through hand placement of the tile spacers at appropriate locations between tiles that are being installed. Tile spacer use has historically been tedious. For instance, a user has had to first retrieve a tile spacer for use (e.g., grab an individual tile spacer from a bag of tile spacers), then properly orient the tile spacer within their hand(s) for placement (e.g., grip one end of a tile spacer between the user's index finger and thumb), and then place the tile spacer on end between two tiles without having the tile spacer fall over or out of alignment during placement of the tile spacer and movement/alignment of the adjacent tiles. This sequence of actions is then performed for each tile spacer that is used during installation of tiles, which, when considering that tile jobs often require the use hundreds of tile spacers, can in the aggregate be quite time consuming and tedious. When manually placing tile spacers, a user may have to take his/her focus away from the area of interest between tile spacers to grab and properly orient the next tile spacer. This shifting focus between preparing the next tile spacer and the area of interest (e.g., the gap between the tiles) can additionally cause manual placement of the tile spacers to be a slow process.

SUMMARY

This document generally describes technology for dispensing tile spacers, such as handheld devices that store and dispense tile spacers. For example, a handheld device can be provided with a storage chamber for tile spacers and a dispensing mechanism (e.g., a palm trigger, button, moveable handle/grip) that, when used (e.g., depressed, moved), causes a tile spacer to be moved from the storage chamber, through an opening of the handheld device, and out of the handheld device for placement at a particular location, such as between two tiles.

In a first general aspect, a handheld device for placing tile spacers includes a body that is sized and shaped for a user to hold; a cartridge enclosed within the body that stores a plurality of tile spacers; an input mechanism affixed to the body that is moveable based on application of force by the user; an opening in the body that is sized and shaped for tile spacers; and a dispensing mechanism contained within the body that, in response to an application of force to the input mechanism by the user, causes a particular tile spacer from the plurality of tile spacers to be moved from the cartridge and out of the opening.

The handheld device can optionally include one or more of the following features. The handheld device can further include a retention mechanism disposed in a proximity to the opening, where the retention mechanism may be configured to retain the particular tile spacer when it is partially extended out of the opening. The input mechanism can include a palm trigger, a button, a handle, or an element that is slideable along a track. The cartridge can be a removable cartridge that contains the plurality of tile spacers. The cartridge can include a front surface and a lower surface, and the front surface can define an angle of about 45 degrees with the lower surface. The handheld device can further include a forward-pressure mechanism that includes a spring, and the forward-pressure mechanism can impart a forward pressure on the plurality of tile spacers. The forward-pressure mechanism can include an angled surface that can impart the forward pressure on a rear-most tile spacer of the plurality of tile spacers. The angled surface of the forward-pressure mechanism can impart the forward pressure on the rear-most tile spacer of the plurality of tile spacers from a location generally below an upper surface of the cartridge. The handheld device can also include a chamber within the body, where the chamber configured to retain the cartridge within the body. The cartridge can include a first opening in an upper surface of the cartridge and a second opening in a lower surface the cartridge. Each of the first opening in the upper surface of the cartridge and the second opening in the lower surface the cartridge can be covered by a removable or breakable material. The dispensing mechanism can include a first leg and a second leg. The dispensing mechanism can include a void disposed between the first leg and the second leg, wherein at least a portion of the void is sized to fit a portion of a tile spacer of the plurality of tile spacers. The dispensing mechanism can be integral with the input mechanism. The cartridge can include a lower surface of the cartridge that defines a channel in the lower surface of the cartridge.

In a second general aspect, a cartridge of tile spacers includes an enclosure that is sized and shaped to house a plurality of tile spacers. The enclosure includes a top surface that defines a first opening that is sized and shaped for a dispensing mechanism to pass through, and a bottom surface that defines a second opening that is sized and shaped for a tile spacer having a particular orientation to pass through; a front surface that defines an angle of about 45 degrees with the bottom surface; side surfaces; and an opening at a rear end of the cartridge, where the opening at the rear end and the first and second openings are covered by a removable or breakable material.

The details of one or more implementations are depicted in the associated drawings and the description thereof below. Certain implementations may provide one or more advantages. For example, the disclosed tile spacer dispensers can increase the efficiency with which tile setters work with and use tile spacers. The disclosed tile spacer dispensers can make tile installation faster and more efficient by providing handheld devices that are able to, with the movement of an input mechanism (e.g., push or grip of a trigger, push of a button or grip of a handle), dispense tile spacers at the location of a user's choosing and with a consistent orientation.

In certain implementations, the disclosed tile spacer dispensers can additionally increase the speed with which users can place tile spacers by being able to quickly and repeatedly dispense tile spacers without having to take a user's hands or focus away from the work area. For instance, in a gap between two tiles where grout will eventually be placed, two or more tile spacers may be used to ensure that the two tiles have consistent spacing along the gap. Using the tile spacer dispensers described in this document, a user can simply move the tile spacer dispenser down the gap between the two tiles and, at appropriate locations along the gap, such as at or near the ends of the two tiles, can apply a force to the tile spacer dispenser to place a tile spacer. The user can keep his/her focus on the area of interest (e.g., the gap between the two tiles) while doing this and simply move the tile dispenser and repeat the force application to repeat the action.

In a further example, the disclosed tile spacer dispensers can be configured to retain a tile spacer while the tile spacer is extending partway out of an opening of the tile spacer dispensers before placing the tile spacer, which can allow for greater accuracy while placing tile spacers. For example, a tile spacer dispenser can include one or more pliable retaining surfaces (e.g., rubber coatings or rubber wedges) that abut an opening through which tile spacers are dispensed so as to impede continued progression of the tile spacers through the opening without additional force being applied by the user. In another example, a tile spacer dispenser can include an internal retention mechanism that grasps tile spacers and only releases the tile spacers when directed to do so by a user, such as the user releasing a button, grip, or slider of the tile spacer dispenser. Such mechanisms to grasp or otherwise impede movement of tile spacers out of an opening of a tile spacer dispenser can aid users in not only visually verifying the placement locations, but can also help users place tile spacers at any angle (e.g., vertically, horizontally) and can also allow for users to more easily move/align adjacent tiles to be properly spaced by tile spacers (e.g., hold the tile spacer partially extended through the opening of the tile spacer dispenser while moving adjacent tiles into place and then release the tile spacer from the dispenser once the tiles have been moved into their appropriate locations).

In another example, the ease and efficiency with which tile spacers can be placed can be increased through the use of replaceable cartridges of tile spacers. Instead of having to align the tile spacers individually within a tile spacer dispenser or attempting to transfer a package of aligned tile spacers to a cartridge of a tile spacer dispenser, a cartridge of tile spacers can simply be inserted into tile spacer dispensers and tile spacers can be extracted from the cartridge for placement at designated locations.

In a further example, tile spacer dispensers can be made out of durable materials and can use mechanical components that will continue to operate properly under frequent and vigorous use. Tile installation can be dirty and, as a result, can cause the tools that are used to get dirty. The disclosed tile spacer dispensers can continue to operate and function properly once dirty, which can be helpful for users who want a reliable and consistent tool.

Other features, objects, and advantages of the technology described in this document will be apparent from the description and the drawings, and from the claims.

BRIEF DESCRIPTION OF THE DRAWINGS

FIGS. 6A-J depict an example tile spacer dispenser, an example tile spacer, and an example cartridge of tile spacers.

Like reference symbols in the various drawings indicate like elements.

DETAILED DESCRIPTION

Figures 1A, 1B, 1C, 1D, 1E:
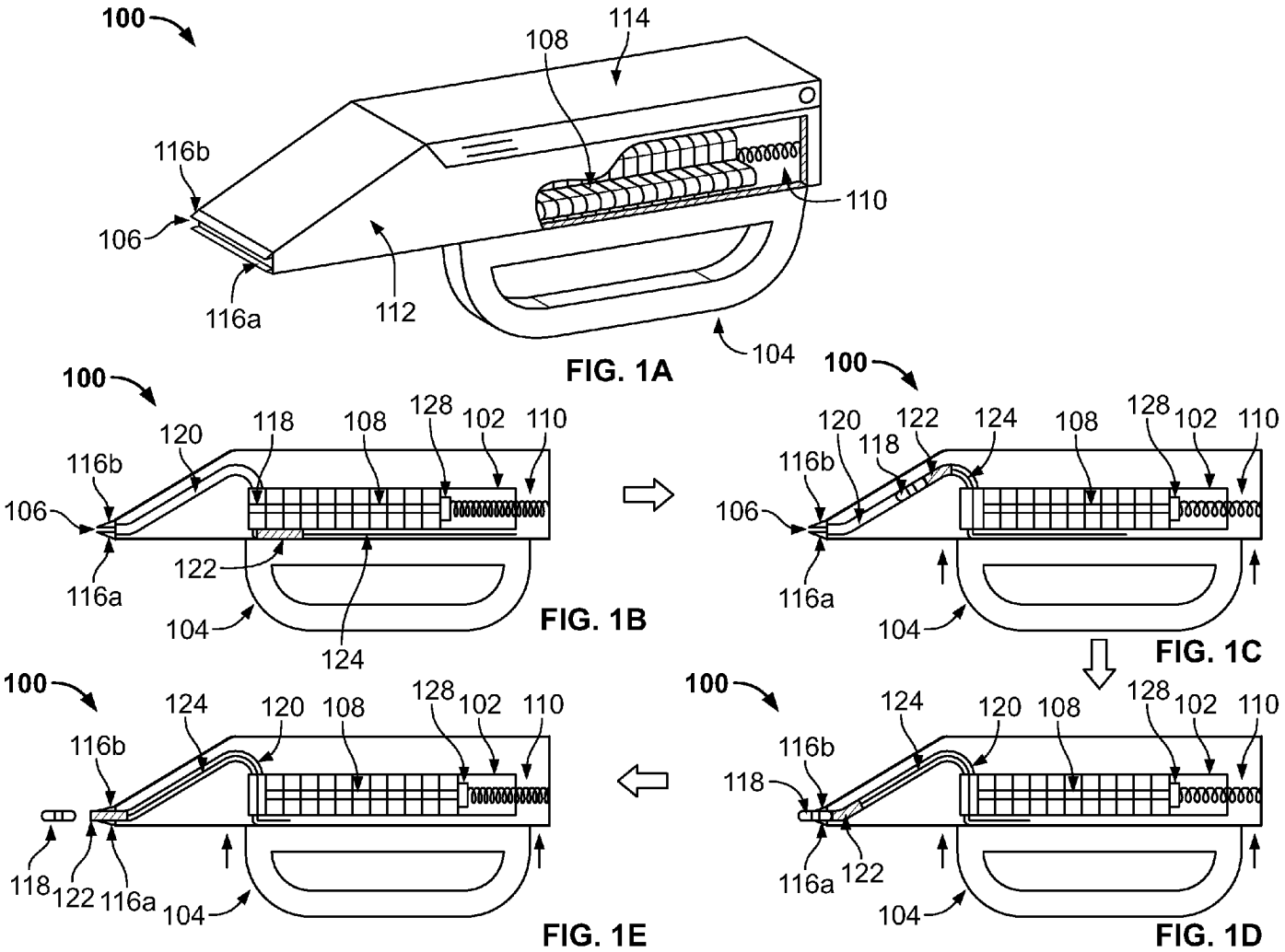
FIGS. 1A-I depict an example tile spacer dispenser and tile spacer cartridge.

FIGS. 1A-I depict an example tile spacer dispenser 100 and tile spacer cartridge 102. In the depicted example, the tile spacer dispenser 100 includes an example handle 104 that can be gripped/squeezed (drawn into the body of the dispenser 100) by a user to dispense a tile spacer out of an opening 106 at a front of the dispenser 100. The tile spacer dispenser 100 can store tile spacers 108 that are properly oriented and positioned within the dispenser 100 for dispensing. As depicted, the spacers 108 can be stacked and a first of the tile spacers 108 (first tile spacer at a front end of the spacers 108) can be dispensed when the handle 104 is gripped/squeezed by a user. A mechanism, which in this example is a spring 110, can be positioned between a last of the tile spacers 108 and a rear, interior surface of the dispenser 100 to apply forward pressure against the tile spacers 108 so that a first (forward most) of the tile spacers 108 is properly positioned to be dispensed.

FIG. 1A depicts a perspective view of the example dispenser 100 with a portion of a side surface 112 of the dispenser 100 removed to present the stacked and oriented spacers 108, and the spring 110. The tile spacers 108 can be stored within an internal chamber within the dispenser 100 and can be dispensed from the chamber one by one as the handle 104 is squeezed/gripped by a user.

The chamber can be accessible in any of a variety of ways, such as through removable and/or hinged surfaces permitting access to the chamber. For instance, the example dispenser 100 includes a hinged top surface 114 that can be opened to insert tile spacers for dispensing. In some implementations, the hinged top surface 114 can draw the spring 110 backward when the hinged top surface 114 is opened, creating open space within the chamber for the addition of tile spacers to the stacked and oriented tile spacers 108.

Tile spacers can be individually added to the chamber of the dispenser 100 and/or as a group. For instance, the example a tile spacer cartridge 102, which can include a group of tile spacers that are pre-stacked and pre-oriented in a particular manner such that they can be properly dispensed by the dispenser 100, can be inserted into the dispenser 100 when the top surface 114 is opened. The tile spacer cartridge 102 can be a single-use and/or reusable cartridge. For example, the tile spacer cartridge 102 can be made of materials that are disposable/recyclable, such as paper, cardboard, and/or recyclable plastics, and can include a stack of tile spacers that are all properly oriented in a particular way for dispensing by one or more dispensing mechanisms of the dispenser 100. In another example, the tile spacer cartridge 102 can be made out of a more durable material and can include one or more ways to gain access to the cartridge, such as through a hinged surface and/or removable end, to refill the cartridge with tile spacers.

The dispenser 100 can additionally include example tile spacer retention mechanisms 116*a-b* that can retain the tile spacer being dispensed when the tile spacer is partway through the opening 106. The depicted tile spacer retention mechanisms 116*a-b* in this example are flexible pieces of material (e.g., rubber, brush bristles) that are affixed to the dispenser 100 adjacent to top and bottom sides the opening 106 and that extend inward and impede upon the vertical spacing of the opening 106. The retention mechanisms 116*a-b* can retain a tile spacer that partially extends through the opening 106 so that, once the tile spacer has been moved into such a position through a user gripping/squeezing the handle 104, the tile spacer does not fall out of or back into the opening 106, regardless of the angle of the dispenser 100 (e.g., downward angle so that the tile spacer extends vertically toward the ground, upward angle so that the tile spacer extends vertically toward a ceiling surface) without further movement of the handle 104 by the user.

Other implementations of the retentions mechanisms 116*a-b* are also possible. For example, retention mechanisms can be positioned additionally and/or alternatively adjacent to the right and left sides of the opening 106 and can impede upon the horizontal spacing of the opening 106. In another example, the retention mechanisms 116*a-b* can be pieces of compressible materials that are affixed to one or more of the inner surfaces of the opening 106. Other implementations are also possible.

FIGS. 1B-E depict side views the tile spacer dispenser 100 and an example dispensing mechanism, with components 120, 122, 124, of the dispenser 100 for dispensing a first tile spacer 118 from the internal storage chamber of the dispenser 100. The example dispensing mechanism includes a channel 120 through the tile spacer 118 can travel from its initial position, as depicted in FIG. 1B, and out of the opening 106, as depicted in FIG. 1E; an plunger 122 that is shaped and sized to contact and to move the tile spacer 118 down the channel 120; and drive mechanism 124 that is connected to the plunger 122 and that is configured to move the plunger forward and backward along the channel 120 based on the handle 104 being gripped/squeezed and released by a user (drawing the handle 104 up into/toward the body of the dispenser 100 and releasing the handle 104 so that it moves outward/away from the body of the dispenser 100).

The channel 120 can be curved in one or more dimensions and can cause the tile spacer 118 to be rotated from a first orientation in its starting position in FIG. 1B to a different, second orientation as it exits the opening 106, as depicted in FIG. 1E. For instance, the example channel 120 extend vertically from the starting position of the tile spacer 118, then is curved to the left so as to cause the tile spacer 118 to rotate more than 90 degrees counter-clockwise, and then toward the opening 106 is curved to the right to cause the tile spacer 118 to rotate clockwise. The ending orientation of the tile spacer 118 from this example channel 120 is an approximately 90 degree rotation in a counter-clockwise direction (from the side vantage point depicted in FIGS. 1B-E) from its starting orientation, as depicted in FIG. 1B. The channel 120 can be defined by one or more interior surfaces with curved and straight portions that are sized for the tile spacer 118. Angles for the curved portions of the channel 120 can be selected so as not to exceed an angle at which the tile spacer 118 can bend/flex with a threshold degree of resistance or less along the channel 120. The tile spacer 118 can be made of a flexible material, such as plastic materials, rubber materials, or other suitable materials. Likewise, the plunger 122 and the drive mechanism 124 can be made of flexible materials that are able to bend/flex along the path of the channel 120.

Also depicted in FIGS. 1B-E, the tile spacers can be stored in the dispenser 100 and dispensed from within the example cartridge 102 of tile spacers. For example, the example spring 110 can pass through an opening at the end of the cartridge, such as the opening 126 depicted in FIG. 1F, that is sized to permit a cap 128 affixed to the end of the spring 110 to pass through the opening (e.g., the opening 126) while restricting the tiles spacers (e.g., the tile spacer 118) from passing through the opening. The cartridge 102 can also include openings in its top and bottom surfaces, such as openings 130 and 132 depicted in FIGS. 1F and 1G, that are sized and positioned along the cartridge 102 so as to permit the plunger 122 and the drive mechanism 124 to pass through the them (openings in top and bottom surfaces of the cartridge 102) and into the channel 120 with the tile spacer 118. The openings in the top and bottom surfaces (e.g., the openings 130 and 132) can initially covered by an easily breakable/removable material (e.g., plastic wrap, paper) that can keep the tile spacers 118 from falling out of or otherwise passing through the openings until removed/broken. For example, a user can place the cartridge 102 in the dispenser 100 with top and bottom surface openings being covered and can puncture the material covering the openings by simply squeezing/gripping the handle 104 so as to drive the plunger 122 through material covering the bottom opening and the tile spacer 118 through the material covering the top opening. The user can then proceed to dispense the tile spacer 118 and the other tiles spacers in the cartridge 102 until all of the tile spacers have been dispensed and the cartridge 102 is ready to be replaced.

Referring to FIG. 1B, in an example starting position for dispensing tile spacers from the dispenser 100, the tile spacer 118 is currently in the first/front position of the cartridge 102 and is the next tile spacer to be dispensed by the dispenser 100. The plunger 122 and the drive mechanism 124 are in a retracted position below the cartridge 102.

Referring to FIG. 1C, the user has squeezed/gripped the handle 104 by drawing the handle 104 partway up/into the body of the dispenser 100, which has caused the drive mechanism 124 to move forward into the cartridge 102 and down the channel 120, which in turn has caused the plunger 122 (affixed to the drive mechanism 124) to physically contact and push the tile spacer 118 out of the cartridge 102 and along the channel 120. As depicted in FIG. 1C, the tile spacer 118 is positioned partway down the channel 120 and between its starting position in the cartridge 102 and the opening 106 at the end of the channel 120.

Referring to FIG. 1D, the user has continued to squeeze/grip the handle 104 by drawing the handle 104 further up/into the body of the dispenser 100, which has caused the tile spacer 118 to move further along the channel 120 and to extend partway through the opening 106. In this position, the tile spacer 118 can physically contact the tile spacer retention mechanisms 116*a-b* which, through the physical contact, can retain the tile spacer 118 in that position and can keep the tile spacer 118 from falling out of the opening 106. For example, if the dispenser 100 with the tile spacer 118 partially extending out of the opening 106 were to be oriented by a user so that the opening 106 is facing (parallel to) the ground and an outward gravitational force is exerted on the tile spacer 118 (gravitational force in direction from right to left from the vantage point depicted in FIG. 1D), the retention mechanisms

116*a-b* can retain the tile spacer 118 in its position and keep the tile spacer 118 from falling out of the opening 106.

Additionally, when the tile spacer 118 reaches and physically contacts the retention mechanisms 116*a-b*, a greater level of resistance may be encountered by the drive mechanism 124 than when the tile spacer 118 is moving along the channel 120. This greater level of resistance can be felt through the handle 104, which may be more difficult for a user to squeeze/grip (require a greater level of force) when the tile spacer 118 reaches the retention mechanisms 116*a-b*. This resistance can provide haptic feedback to the user as to when the tile spacer 118 has reached the opening 106, which can provide a user with an indication as to when he/she should move the dispenser 100 to a location where the tile spacer 118 is intended to be dispensed.

Referring to FIG. 1E, the handle 104 has been further squeezed/gripped so that the handle 104 is further drawn up/into the body of the dispenser 100, which has caused the tile spacer 118 to be forced out of the opening 106 and past the retention mechanisms 116*a-b* by the plunger 122 and the drive mechanism 124. For example, the user can place the tile spacer 118 as it is partially extended through the opening 106, as depicted in FIG. 1D, in a gap between two adjacent tiles and then proceed to squeeze/grip the handle 104 to fully dispense the tile spacer 118 into the gap, as depicted in FIG. 1E.

Although not depicted, a user can retract the plunger 122 and drive mechanism 124 by releasing the handle 104, which may return to its starting position (as depicted in FIG. 1B) either automatically (e.g., through the use of internal mechanisms that have built up potential energy when the handle 104 was gripped/squeezed, such as one or more springs or bows) or manually (e.g., by the user extending the handle 104 outward and away from the body of the dispenser 100). As the handle 104 returns to its starting position, it can draw the drive mechanism 124 and the plunger 122 backward along the channel 120 so that they are properly positioned to dispense a next tile spacer from the cartridge 102 which, once the plunger 122 has returned to its position below the cartridge 122, can be forced into the front/first position by the spring 110 and the cap 128.

Figure 1H:
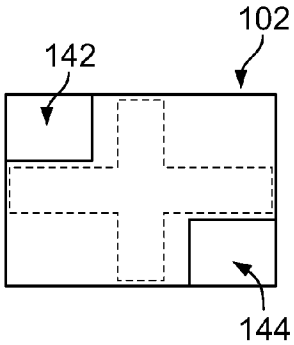
Figure 1I:
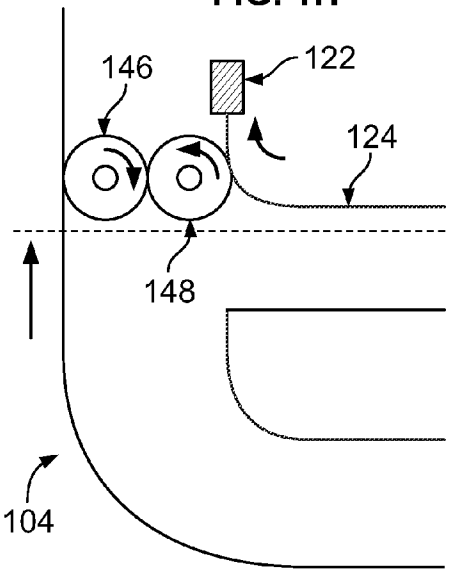
Figure 1F:
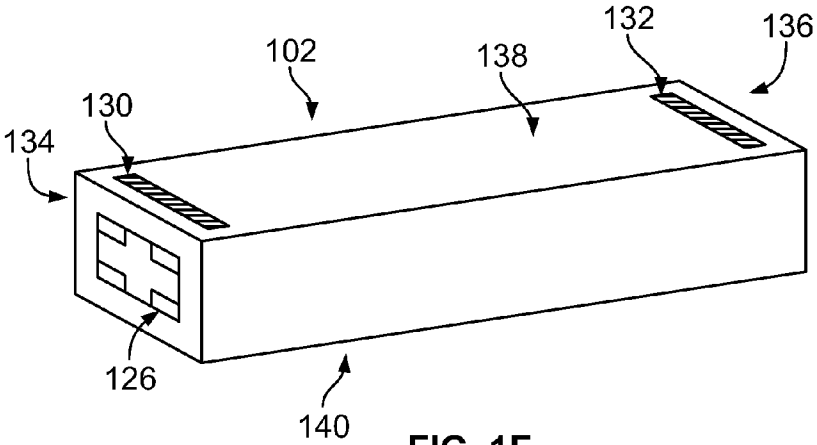
Figure 1G:
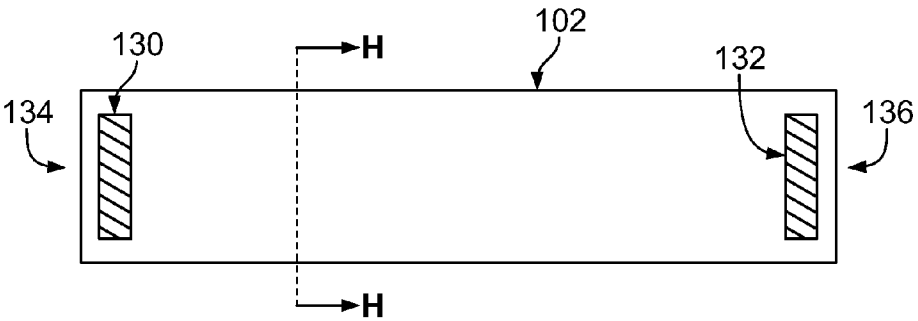

Referring to FIGS. 1F-G, the cartridge 102 can be symmetric along one or more dimensions. For example, the example cartridge 102 includes the opening 130 at a first end 134 of the cartridge and the opening 132 at the second end 136 of the cartridge, which can allow the cartridge 102 to function properly regardless of whether the first end 134 or the second end 136 is inserted into the dispenser 100 as the leading/front end of the cartridge 102. Additionally, both the top surface 138 and the bottom surface 140 of the cartridge 102 can include such symmetric openings (e.g., the top surface 138 and the bottom surface 140 can both resemble the surface depicted in FIG. 1G). Additionally, the second end 136 of the cartridge 102 can include an opening similar to the opening 126 in the first end 134. By having symmetry along one or more dimensions, there can be multiple permissible orientations of the cartridge 102 within the dispenser 100 that are usable. For example, the cartridge 102 can function properly regardless of whether it is inserted with the top surface 138 facing upward or downward, and regardless of whether the first end 134 is the front/leading end or the trailing end within the dispenser 100. Such symmetry can allow a user can more readily and quickly place the cartridge 102 in the dispenser 100 in a useable orientation by providing more possible usable orientations.

FIG. 1H is a view of example internal surfaces 142 and 144 within the cartridge 102 that are sized and located so as to keep tile spacers within the cartridge 102 in a particular orientation. For example, the internal surfaces 142 and 144 extend into the space between adjacent arms of the 'X' shaped tile spacers when oriented vertically and in a stacked configuration. The example internal surfaces 142 and 144 are positioned in opposite corners of the interior of the cartridge 102 and can extend the length of the cartridge 102. Other configurations, orientations of tile spacers, and other internal surfaces are also possible.

FIG. 1I depicts an example configuration of gears 146-148 to move the drive mechanism 124 based on upward and downward movement the handle 104 relative to the body of the dispenser 100. For example, a first gear 146 is in contact with an interior surface of the handle 104 inside of the body of the dispenser 100, and a second gear 148 is in contact with the first gear 146 on one side and the drive mechanism 124 on another side. As the handle 104 is moved upward, the first gear 146 can rotate in a clockwise direction, which can cause the second gear 148 to rotate in a counter-clockwise direction and can cause the drive mechanism 124 (and the plunger 122) to move in a forward direction (e.g., down the channel 120), as indicated by the arrows.

FIGS. 2A-J depict an example tile spacer dispenser 200 and components thereof. The example dispenser 200 and its components can be similar to the dispenser 100 and its components described above with regard to FIGS. 1A-I.

Figures 2A, 2B, 2C, 2D, 2E, 2F, 2G, 2H, 2I, 2J:
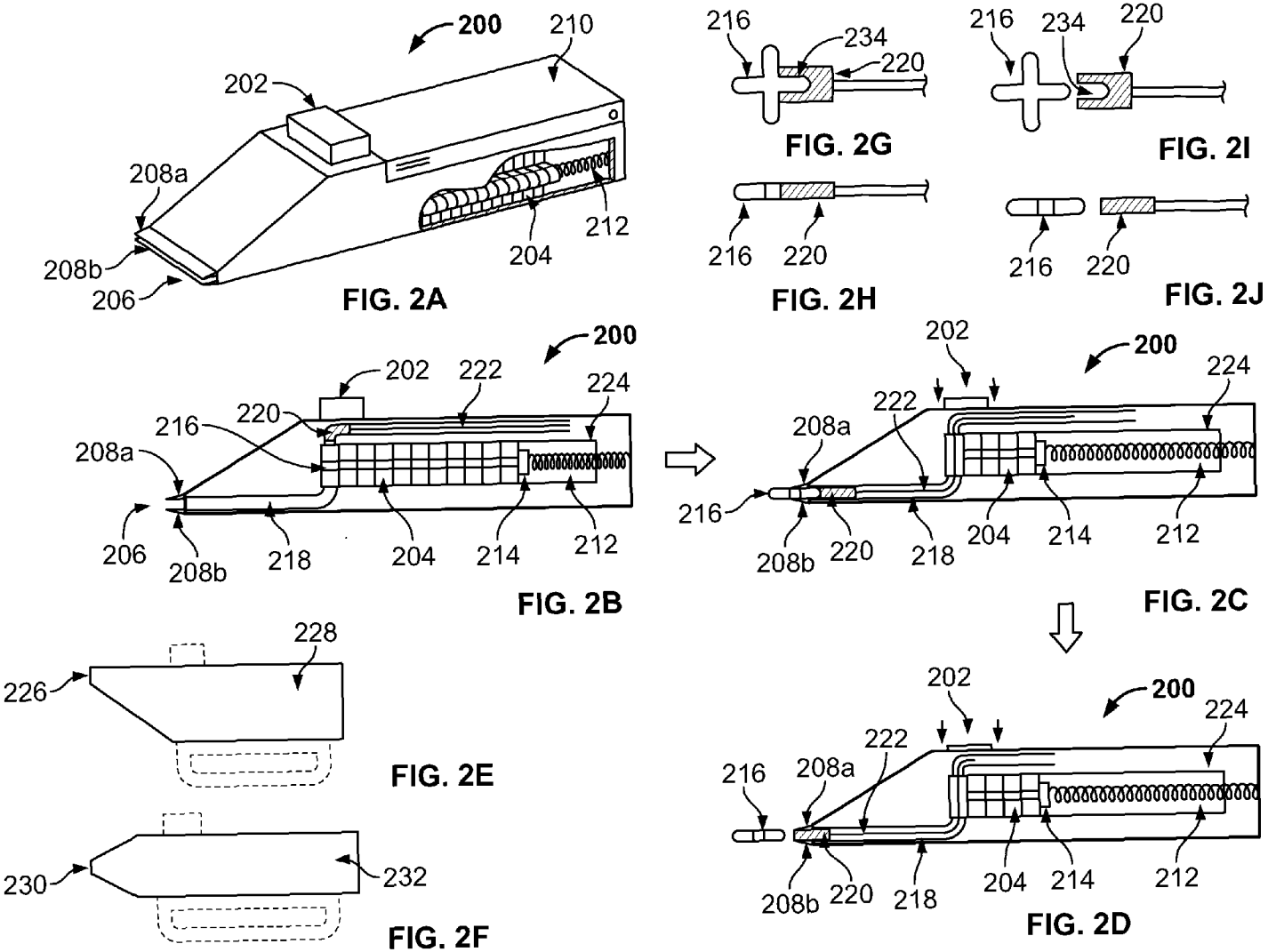
FIGS. 2A-J depict an example tile spacer dispenser and components thereof.

Referring to FIG. 2A, which is a perspective view, the dispenser 200 includes a button 202 on a top surface of the dispenser 200 that, when depressed by a user (e.g., depressed by the user's thumb) can cause one of the tile spacers 204 in a chamber of the dispenser 200 to be dispensed through an opening 206 in a front surface of the dispenser 200. The dispenser 200 can include tile spacer retention mechanisms 208*a-b* affixed near the opening 206 that are similar to the tile spacer retention mechanisms 116*a-b* described above with regard to FIGS. 1A-I. The dispenser 200 can also include a hinged top surface 210 (similar to the top surface 114) through which the tile spacers 204 can be loaded into a storage chamber of the dispenser 200, such as through a cartridge. The dispenser 200 also includes a spring 212 and cap 214 that can be used to force the tile spacers 204 into an appropriate position for dispensing.

Referring to FIGS. 2B-D, side views of the dispenser 200 as it dispenses a first tile spacer 216 are depicted. Like the channel 120, the plunger 122, and the drive mechanism 124 described above with regard to FIGS. 1B-E, the dispenser 200 includes a channel 218 along which the tile spacer 216 can travel to the opening 206, a plunger 220 that can contact the tile spacer 216 and apply force to the tile spacer 216 to move it along the channel 218, and a drive mechanism 222 that is affixed to a rear portion of the plunger 220 and that, in response to a user pressing and releasing the button 202, moves forward and backward along the channel 218. In this depicted example, the plunger 220 and drive mechanism 222 have a starting position that is above the tile spacers 204, which in this example are located within a cartridge 224 (similar to the cartridge 102). In response to a user pressing the button 202, the drive mechanism 222 and the plunger 220 extend downward into the cartridge 224 through an opening in a top surface of the cartridge 224 (similar to the opening 130 in the cartridge 102) and push the tile spacer 216 out of the an opening in the bottom surface of the cartridge 224, down the channel 218, and out of the opening 206 of the dispenser 200.

Referring to FIG. 2B, the dispenser 200 is depicted in a starting position with the tile spacer 216 being located at the front of the stack of tile spacers 204 in the cartridge 224, the button 202 being fully extended/released, and the plunger 220 and the drive mechanism 222 being retracted.

In FIG. 2C, a user has pressed the button 202 at least partway down and into the body of the dispenser 200, which has caused the drive mechanism 222 and the plunger 220 to push the tile spacer 216 out of the cartridge 224 and along the channel 218. As depicted in the example, the tile spacer 216 has been pushed so that it extends partially out of the opening 206 and is in contact with the resistance mechanisms 208*a-b* (similar to the tile spacer 118 being in contact with the resistance mechanisms 116*a-b* described above with regard to FIG. 1D). Such contact between the tile spacer 216 and the resistance mechanisms 208*a-b* can create additional resistance for the drive mechanism 222, which can provide haptic feedback to a user through the button 202, which can be harder (require more force) for a user to depress once the tile spacer 216 has contacted the resistance mechanisms 208*a-b*.

In FIG. 2D, the user has pressed the button 202 down further so as to force the tile spacer 216 out of the opening 206. To retract the plunger 220 and the drive mechanism 222 from this position, the user can release pressure on the button 202, which can automatically return to its starting position as depicted in FIG. 2B. The button 202 returning to its starting position can cause the drive mechanism 222 and the plunger 220 to return to their starting positions as well, and for a next one of the tile spacers 204 to move into the first/forward position within the cartridge 224 for dispensing.

The example dispensers 100 and 200 both include dispensing openings 106 and 206, respectively, which are located near a bottom of a front end of the dispensers 100 and 200. Other positioning of the openings 106 and 206 are also possible. For instance, FIG. 2E depicts an example opening 226 for dispensing tile spacers being located at or near the top of the front end of a dispenser 228, and FIG. 2F depicts an example opening 230 for dispensing tile spacers being located at or near the middle of the front end of a dispenser 232. The example dispensers 228 and 232 can be similar to the dispensers 100 and 200, and can include handles, buttons, or other mechanisms through which users can dispense tile spacers.

FIGS. 2G-J depict a close-up view of the example plunger 220 and its physical interaction with the tile spacer 216. In particular, the example plunger 220 includes a cutout portion 234 that is shaped and dimensioned to fit one of the ends of the tile spacer 216 so that, as the tile spacer 216 is moved along the channel 218, the tile spacer 216 does not unexpectedly change alignment or orientation. FIG. 2G depicts a top view and FIG. 2H depicts a side view of one end of the tile spacer 216 fitting into and physically contacting the cutout portion 234 of the plunger 220. FIG. 2I depicts a top view and FIG. 2J depicts a side view of the tile spacer 216 before it has been in physical contact with the plunger 220, and after it has been released, respectively.

Figure 3A:
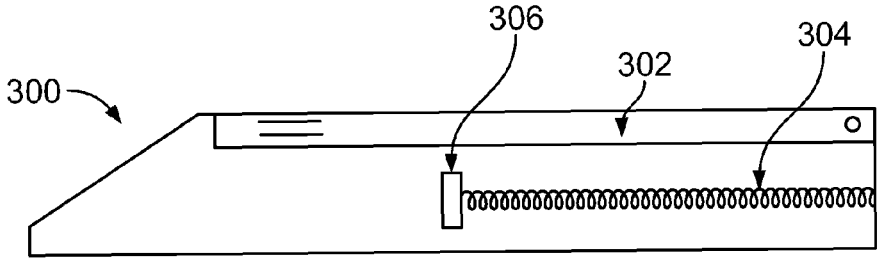
FIGS. 3A-C depict an example of a tile spacer cartridge being inserted into a tile spacer dispenser.
Figure 3B:
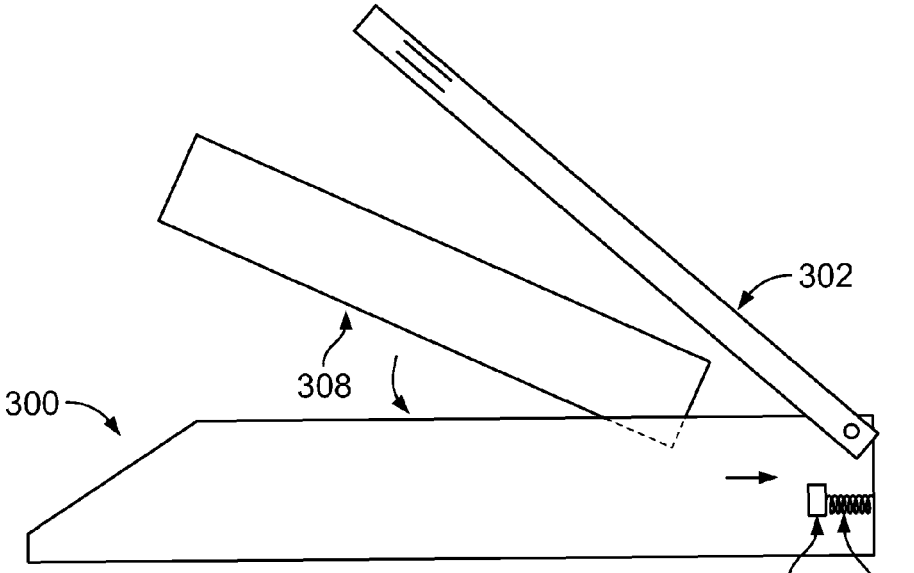
Figure 3C:
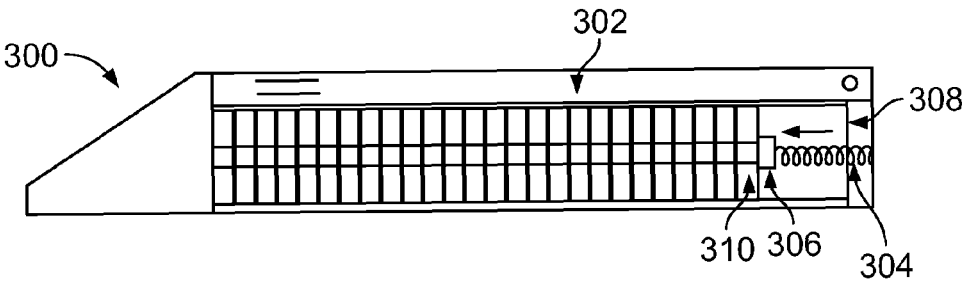

FIGS. 3A-C depict an example of a tile spacer cartridge 308 being inserted into a tile spacer dispenser 300. The tile spacer dispenser 300 can be similar to the other tile spacer dispensers discussed in this document (e.g., the tile spacer dispensers 100 and/or 200) and the tile spacer cartridge can be similar to the other cartridges discussed in this document (e.g., the tile spacer cartridges 102 and/or 224).

Referring to FIG. 3A, the dispenser 300 has a hinged top surface 302, a spring 304, and a cap 306 for the spring 304. Referring to FIG. 3B, a user has opened the top surface 302, which has caused the spring 304 and the cap 306 to retract backward, toward a rear end of the dispenser 300. Such a retraction of the spring 304 and the cap 306 can make way within the dispenser 300 for the cartridge 308 to be inserted.

Referring to FIG. 3C, once the cartridge 308 has been positioned and the top surface 302 has been closed, the spring 304 and the cap 306 can be released, which can allow them to move forward so as to contact a last/rear tile spacer 310 and to apply forward pressure against the stack of tile spacers within the cartridge 308.

Figure 4A:
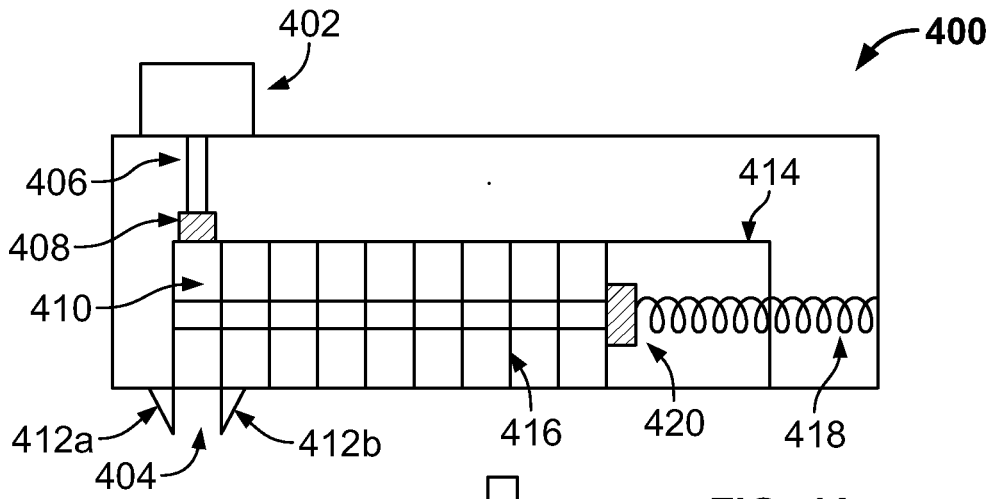
FIGS. 4A-C depict an example tile spacer dispenser.
Figure 4B:
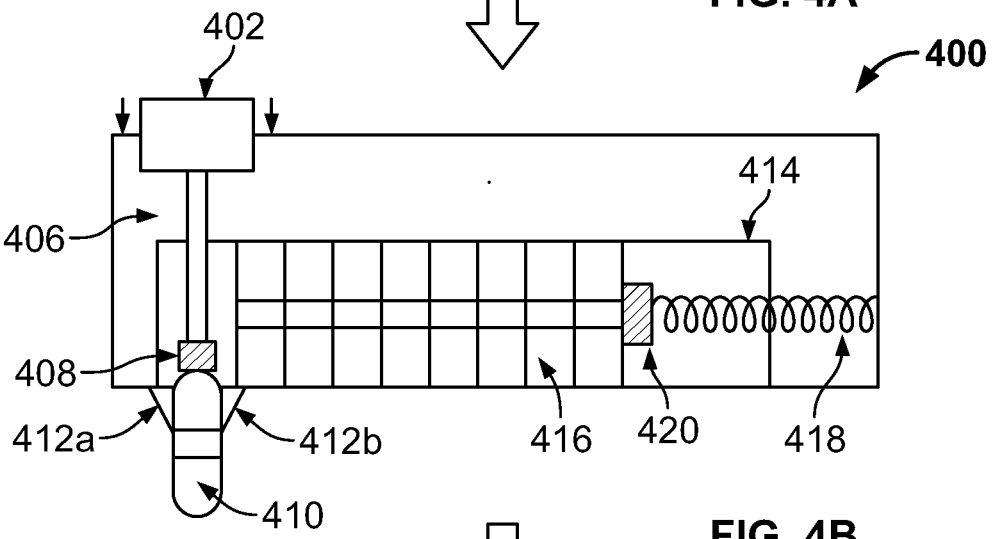
Figure 4C:
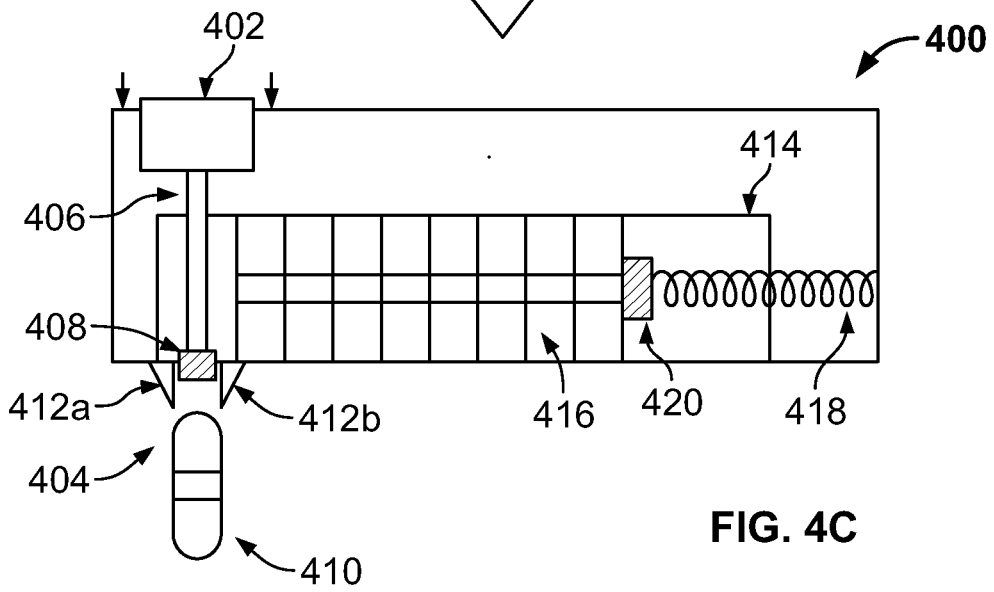

FIGS. 4A-C depict an example tile spacer dispenser 400. The example dispenser 400 includes a button 402 that a user can press to dispense a tile spacer out of an opening 404 of the dispenser 400. The button 402 is connected to a post 406 and a plunger 408 that move up and down based on a user pressing and releasing the button 402. When the button 402 is pressed, the plunger 408 physically contacts and pushes a tile spacer 410 out of the opening 404 of the dispenser 400. Like the openings of the dispensers 100 and 200 described above with regard to FIGS. 1-2, the dispenser 400 can include tile spacer retention mechanisms 412*a-b* that are affixed adjacent to the opening 404 and that physically contact the tile spacer 410 as it exits the opening 404 so as to retain and keep the spacer 410 from falling out of the opening 406.

The example dispenser 400 is also depicted as including a tile spacer cartridge 414 that contains oriented and stacked tile spacers 416. The dispenser 400 can also include a spring 418 and a cap 420 that are configured to apply force to the tile spacers 416 so as to move a first/forward most tile spacer into an appropriate position for dispensing by the plunger 408.

Unlike the dispensers 100 and 200 described above, the dispenser 400 dispenses the tile spacer 410 in substantially the same orientation as tile spacer 410 is stored in the cartridge 414. In contrast, as discussed above, the dispensers 100 and 200 rotate and dispense the tile spacers in an orientation (e.g., horizontal orientation) that is different from the orientation of the tiles spacers as stored within the dispensers 100 and 200 (e.g., vertical orientation).

Referring to FIG. 4A, the tile spacer 410 is the first/forward most of the tile spacers 416 within the cartridge 414, and the button 402, post 406, and plunger 408 are in starting positions that correspond with the button 402 being fully released (not pressed by a user). The cartridge 414 can be similar to the cartridges discussed above with regard to FIGS. 1 and 2, and can include openings in its top and bottom surfaces through which the tile spacer 410, the plunger 408, and the post 406 can pass.

Referring to FIG. 4B, a user has depressed the button 402 partway down, which has caused the plunger 408 to physically contact and push the tile spacer 410 partway out of the opening 404. As discussed above, in this position the tile spacer 410 can be retained by the retention mechanisms 412*a-b* such that it will not fall out of dispenser without further force being applied to the button 402 by the user. In response to such force being applied to the button 402, the button 402 can be depressed further and the tile spacer 410 can be expelled from the opening 404, as depicted in FIG. 4C.

Figure 5:
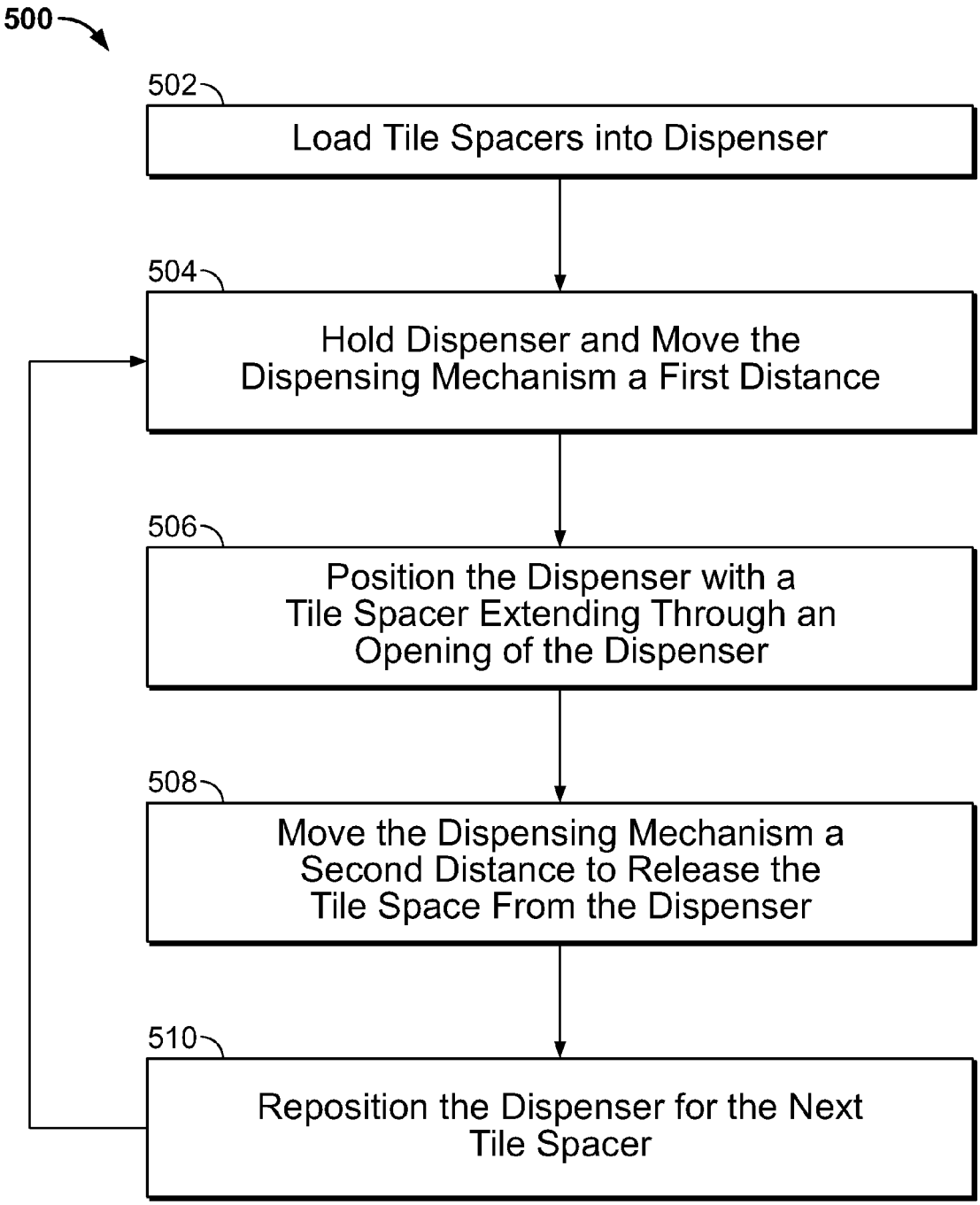
FIG. 5 is a flowchart of an example technique for dispensing tile spacers using tile spacer dispensers.

FIG. 5 is a flowchart of an example technique 500 for dispensing tile spacers using tile spacer dispensers. The technique 500 can be implemented using any of a variety of appropriate tile spacer dispensers, such as the tile spacer dispensers described in this document (e.g., dispensers 100, 200, 300, and 400) or other appropriate dispensers.

A user can load tile spacers into a tile spacer dispenser (502). For example, a user can load a cartridge of tile spacers into a tile spacer dispenser, as described above with regard to FIGS. 3A-C.

The user can hold/grasp the dispenser and move the dispensing mechanism of the dispenser at least a first distance, which can cause a tile spacer to extend partway through an opening of the dispenser (504). For example, the user can squeeze the handle 104 (example dispensing mechanism) a first distance so that the tile spacer 118 extends partially through the opening 106, as described above with regard to FIGS. 1B-D.

The user can position the dispenser at an appropriate location to which the tile spacer should be placed (506). For example, the user can move the dispenser 100 so that the tile spacer 118, while extending partway through the opening 106 (as depicted in FIG. 1D), is positioned in a gap between two adjacent tiles.

The user can move the dispensing mechanism a second distance to release/expel the tile spacer from the dispenser (508). For example, the user can squeeze the handle 104 further (a second distance) so that the tile spacer 118 is released/expelled from the dispenser, as depicted in FIG. 1E.

The user can then reposition the dispenser for dispensing of the next tile spacer (510). For example, the user can release the handle 104 so that the plunger 122 and drive mechanism 124 are retracted to a starting position, and so that the next tile spacer from the cartridge 102 is pushed forward into a dispensing position by the spring 110 and the spring cap 118.

FIGS. 6A-J depict an example tile spacer dispenser 600, an example tile spacer 602, and an example cartridge 604 of tile spacers.

The example tile spacer dispenser 600 includes a slide button 606 that a user can move along a guide path 608 to dispense tile spacers 612 out of an opening 614 of the dispenser 600. FIG. 6A depicts a perspective view of the dispenser 600; FIG. 6B depicts a front view of the dispenser 600; FIG. 6C depicts a rear view of the dispenser 600; FIG. 6D depicts a side view of the dispenser 600; and FIG. 6E depicts a top view of the dispenser 600.

The dispenser 600 can be similar to the dispenser described above, such as the dispensers 100, 200, 300, and 400. For example, the dispenser 600 can dispense tile spacers that are loaded into the dispenser 600 as part of the cartridge 604.

However, the dispenser 600 can include some features that are different from the other dispensers described above. For instance, the example dispenser 600 is not depicted as including retention mechanisms that are affixed near the opening 614. Instead, the dispenser 600 can include internal retention mechanisms to retain and keep a tile spacer that has been partially extended through the opening 614 from falling out of the opening 614 without further input by a user. For example, the dispenser 600 can include retention mechanisms similar to those discussed above (e.g., the retention mechanisms 116*a-b*) that are located internally within the dispenser 600. In another example, the dispenser 600 can include mechanisms that grip tile spacers and that release the grip on the tile spacers based on particular user input through the slide button 606. For instance, such an internal mechanism can grip a tile spacer as the slide button 606 is moved forward and then release the grip on the tile spacer when the slide button 606 is retracted. An example of such an internal mechanism is depicted and described with regard to FIGS. 7-8.

The dispenser 600 is also depicted as including a rear opening 616 through which the cartridge 604 can be inserted into the dispenser 600. In this example, the opening 616 is a square opening that is at a 45 degree angle to the dispenser 600 (appears as a diamond shape). Other configurations and orientations of the opening 616 are also possible.

An example 'X' shaped tile spacer 602 that can be included in the cartridge 604 and dispensed by the dispenser 600 is depicted in FIGS. 6F-H. FIG. 6F is a perspective view of the tile spacer 602, FIG. 6G is a front view of the tile spacer 602, and FIG. 6H is a side view of the tile spacer 602. Other shapes and sizes of tile spacers can also be used, such as 'T' shaped tile spacers.

FIGS. 6I and 6J depict the cartridge 604, with FIG. 6I depicting a perspective view, and FIG. 6J depicting a rear view. The cartridge 604 also includes tabs 620 positioned in two or more corners (three corners in the depicted example: left, right, bottom) of a rear opening 622 of the cartridge 604 that keep the tile spacers 612 from being prematurely pushed out of the cartridge 604. In some implementations, the tabs 620 are automatically removed by the dispenser 600 when the cartridge 600 is fully inserted into the dispenser 600. In some implementations, the tabs 620 are made of a flexible material that can allow tile spacers to be individually removed from the cartridge 604 for dispensing. The cartridge 604 generally includes four outer walls, and as can be best seen in FIG. 6J, two of the outer walls of the cartridge can be partial walls so that the cartridge includes an opening in a top portion of the cartridge when the cartridge 604 is oriented for insertion into the dispenser 600, as depicted in FIG. 6J. The cartridge 604 includes an opening (not shown) in a forward surface (opposite the rear surface) of the cartridge 604, and the tile spacers 612 can be pushed out of the opening in the forward surface of the cartridge 604 and out of the opening 614 in the dispenser 600 for placement. As will be described in further detail below, cartridge 604 can be used with dispenser 1000 (see, e.g., FIG. 10) in some examples.

FIGS. 7A-F depict an example of a user 700 dispensing a tile spacer 702 using an example tile spacer dispenser 704. In the depicted example, the dispenser 704 has a slide button 706 that the user 700 can slide forward to partially extend the tile spacer 702 while the tile spacer 702 is still being retained by the dispenser 704, and that will release/expel the tile spacer 702 when the slide button 706 is retracted. The dispenser 704 can be similar to the tile spacer dispenser 600 described above with regard to FIG. 6. The example depicted in FIGS. 7A-F, and/or variations thereof, can be performed using other tile spacer dispensers, such as the dispensers 100, 200, 300, 400, and/or other appropriate tile spacer dispensers.

Figures 7A, 7B, 7C, 7D, 7E, 7F:
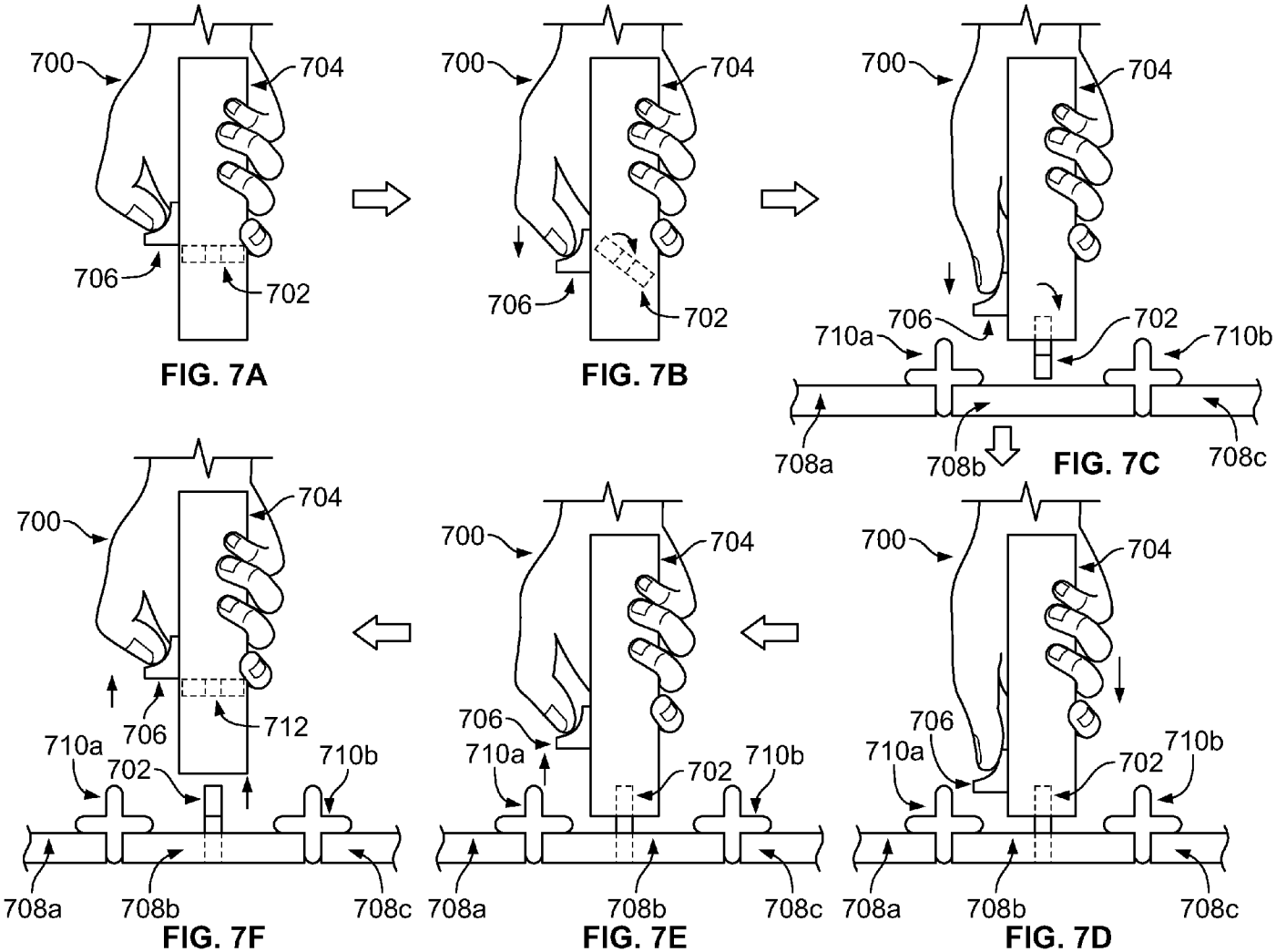
FIGS. 7A-F depict an example of a user dispensing a tile spacer using an example tile spacer dispenser.

Referring to FIG. 7A, the slide button 706 is retracted and the tile spacer 702 is in a starting position within the dispenser 700 and with a starting orientation.

Referring to FIG. 7B, the user 700 has slid the slide button 706 partway forward along a guide, which has caused the tile spacer 702 to be partially rotated toward a second orientation at which the tile spacer 702 will be released/dispensed from the dispenser 704.

Referring to FIG. 7C, the user 700 has fully extended the slide button 706 along the guide, which has caused the tile spacer 702 to be partially extended out of an opening in a front end of the dispenser 704. The tile spacer 702 can be in the second orientation when it is partially extended from the dispenser 704. The second orientation is different from the first orientation. When in this position, the tile spacer 702 can be gripped by an internal mechanism of the dispenser 704 so that the tile spacer 702 does not fall out of the dispenser 704 prematurely. The user 700 can position the dispenser 704 at or near a location where the tile space 702 is intended to be placed. For instance, the dispenser 704 is positioned above a gap between a tile 708*b* and adjacent tile located behind the tile 708*b*. Other tile spacers 710*a* and 710*b* are depicted as already having been positioned between tiles 708*a* and 708*b*, and between tiles 708*b* and 708*c*, respectively.

Referring to FIG. 7D, the user 700 has lowered the tile spacer 702 into the gap between the tile 708*b* and the adjacent tile (not visible) located behind the tile 708*b*. While in such a position, the user 700 may adjust the positioning of the tile

708*b* and/or the adjacent tile so that they contact the tile spacer 702, which can ensure that uniform gaps between the tiles are formed and, when grout is applied, that the grout lines are uniform as well. The user 700 can position the tile spacer 702 while keeping the slider button 706 in the extended position.

Referring to FIG. 7E, the user 700 can retract the slider button 706, which can cause the tile spacer 702 to be released by the internal mechanism of the dispenser 700 that was gripping the tile spacer 702.

Referring to FIG. 7F, the user 700 can further retract the slider button 706 to the same starting position depicted in FIG. 7A so that the dispenser 704 is ready to dispense a next tile spacer 712. The user 700 can also withdraw the dispenser 704 from the placement location of the tile spacer 702, and the tile spacer 702 can remain in its position between the tile 708*b* and the adjacent tile.

FIGS. 8A-H depict an example internal mechanism of a tile spacer dispenser 800 for gripping and releasing tile spacers at appropriate times. The example dispenser 800 can be similar to the dispensers 600 and 704 described above with regard to FIGS. 6 and 7. The depicted internal mechanism may also be applied to other tile spacer dispensers, such as the tile spacer dispensers 100, 200, 300, 400, and/or other appropriate tile spacer dispensers.

The dispenser 800 includes a slider button 802 that is affixed to a series of teeth/grooves 804 that are configured to engage and drive a gear 806. The gear 806 can in turn physically engage a gear 808 to which arms 810*a-b* are attached by hinges. The arms 810*a-b* can travel along curvilinear tracks with raised portions 812*a-b* and lowered portions 814*a-b*. When traveling along the raised portions 812*a-b*, the arms 810*a-b* can be forced inward so as to grip a tile spacer 816. When traveling along the lowered portions 814*a-b*, the arms 810*a-b* can expand laterally (inward force can be removed) so as to release the grip on the tile spacer 816 (e.g., distance between the arms 810*a-b* can be greater than the width of the arm of the tile spacer 816).

Additionally, affixed to the gear 808 are stops 818*a-b* that are positioned to allow for the portion of the arms 810*a-b* that extend beyond the edge of the gear 808 to change as the arms travel along the tracks with the raised portions 812*a-b* and lowered portions 814*a-b*. For instance, the stops 818*a-b* can cause the arms 810*a-b* to extend beyond the edge of the gear 808 by a greater distance when the approach and grip the tile spacer 816 (travel along the raised portion 812*a*) than when they release and prepare to grip a next tile spacer (travel along the lowered portion 814*a-b*).

Figures 8A, 8B, 8C, 8D, 8E, 8F, 8G, 8H:
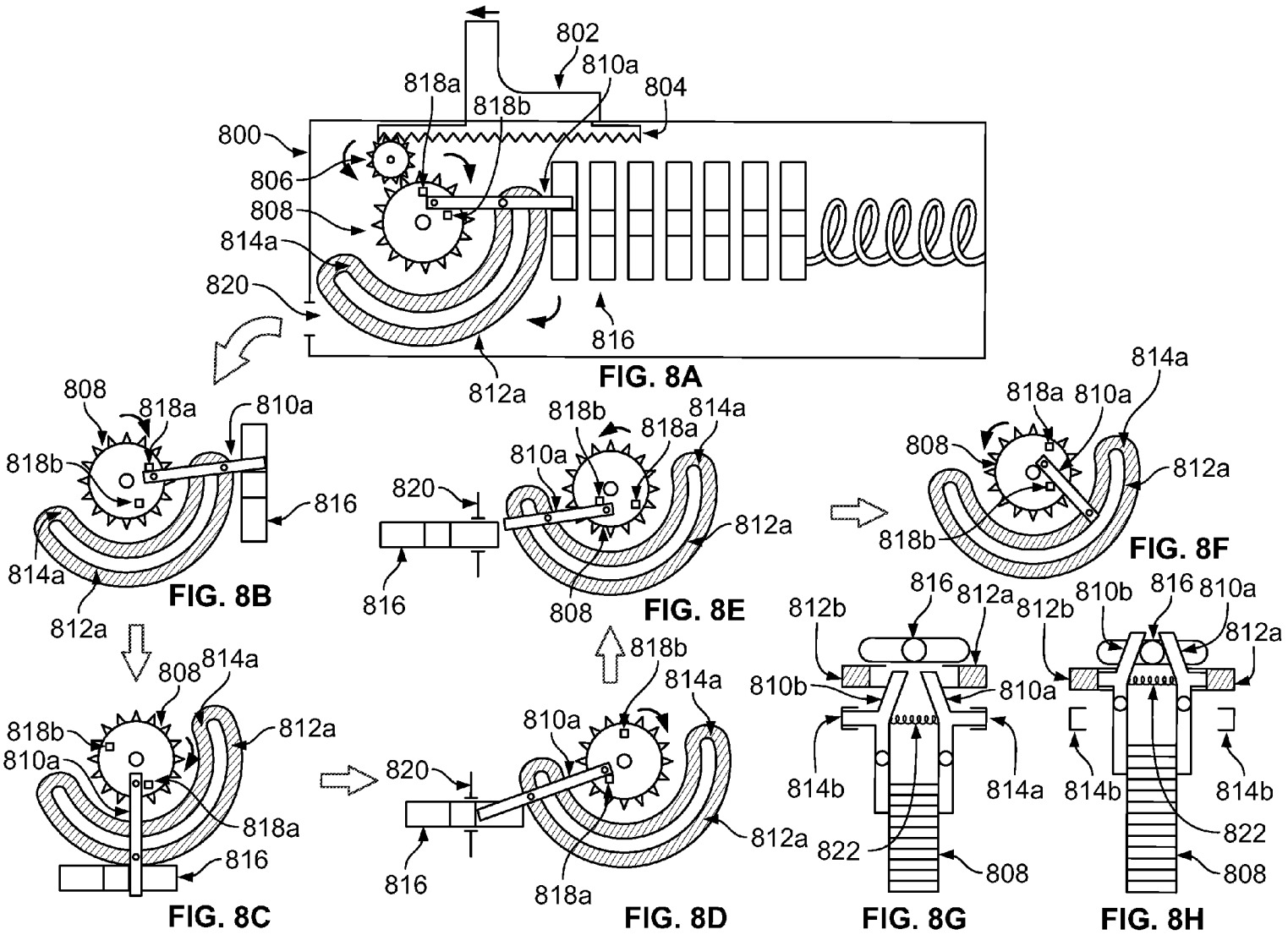
FIGS. 8A-H depict an example internal mechanism of a tile spacer dispenser for gripping and releasing tile spacers at appropriate times.

Referring to FIG. 8A, the arm 810*a* is depicted as transitioning from the lowered portion 814*a* to the raised portion 812*a* of the track and to be in contact with the stop 818*b*, which provides for the arm 810*a* to extend beyond the edge of the gear 808 by a shorter distance.

Referring to FIG. 8B, the arm 810*a* has transitioned to the raised portion 812*a* of the track and is in physical contact with the stop 818*a*, which provides for the arm 810*a* to extend further beyond the edge of the gear 808 than in FIG. 8A, allowing for the arm 810*a* to reach out to and grip the tile spacer 816.

Referring to FIG. 8C, the arm 810*a* continues to travel along the raised portion 812*a* of the track while in physical contact with the stop 818*a*, which provides for the arm 810*a* to continue to grip the tile spacer 816 while at the same time rotating the tile spacer 816 from its original orientation.

Referring to FIG. 8D, the arm 810*a* has travelled to an end of the raised portion 812*a* of the track, which can correspond to an end point on the guide for the slide button 802. In this position, the arm 810*a* can grip the tile spacer 816 while extending the tile spacer 816 partially through an opening 820 of the dispenser 800.

Referring to FIG. 8E, as the user reverses the direction of the gear 808 by retracting the slider button 802, the arm 810*a* can travel along the lowered portion 814*a* of the track instead of along the raised portion of the track 812*a*. By transitioning to the lowered portion 814*a* of the track, the arms 810*a-b* can expand in their distance between each other and can release their grip on the tile spacer 816, allowing the tile spacer 816 to pass freely through the opening 820. While travelling along the lowered portion 814*a* of the track, the arm 810*a* can additionally be in physical contact with the stop 818*b*, which can cause the arm 810*a* to extend beyond the edge of the gear 808 by a shorter distance than when it is in physical contact with the stop 818*a*.

Referring to FIG. 8F, the arm 810*a* can return to its starting position in FIG. 8A as the user continues to retract the slider button 802 by travelling along the lowered portion 814*a* of the track and while in physical contact with the stop 818*b*.

FIGS. 8G-H depict a top down view of the gear 808, the arms 810*a-b*, the raised portions 812*a-b* of the tracks, the lowered portions 814*a-b* of the tracks, and the tile spacer 816. FIG. 8G depicts a view while the arms 810*a-b*, which can include posts that extend down into the tracks, while they travel along the lowered portions 814*a-b* of the tracks. FIG. 8H depicts a view while the arms 810*a-b* travel along the raised portions 812*a-b* of the tracks. In addition to having posts extending down into the tracks, the arms 810*a-b* can be laterally hinged so that the distance separating them can change, and they can be connected by a spring 822 (or other mechanical mechanism) that is capable of forcing the arms 810*a-b* apart from each other.

Figure 9:
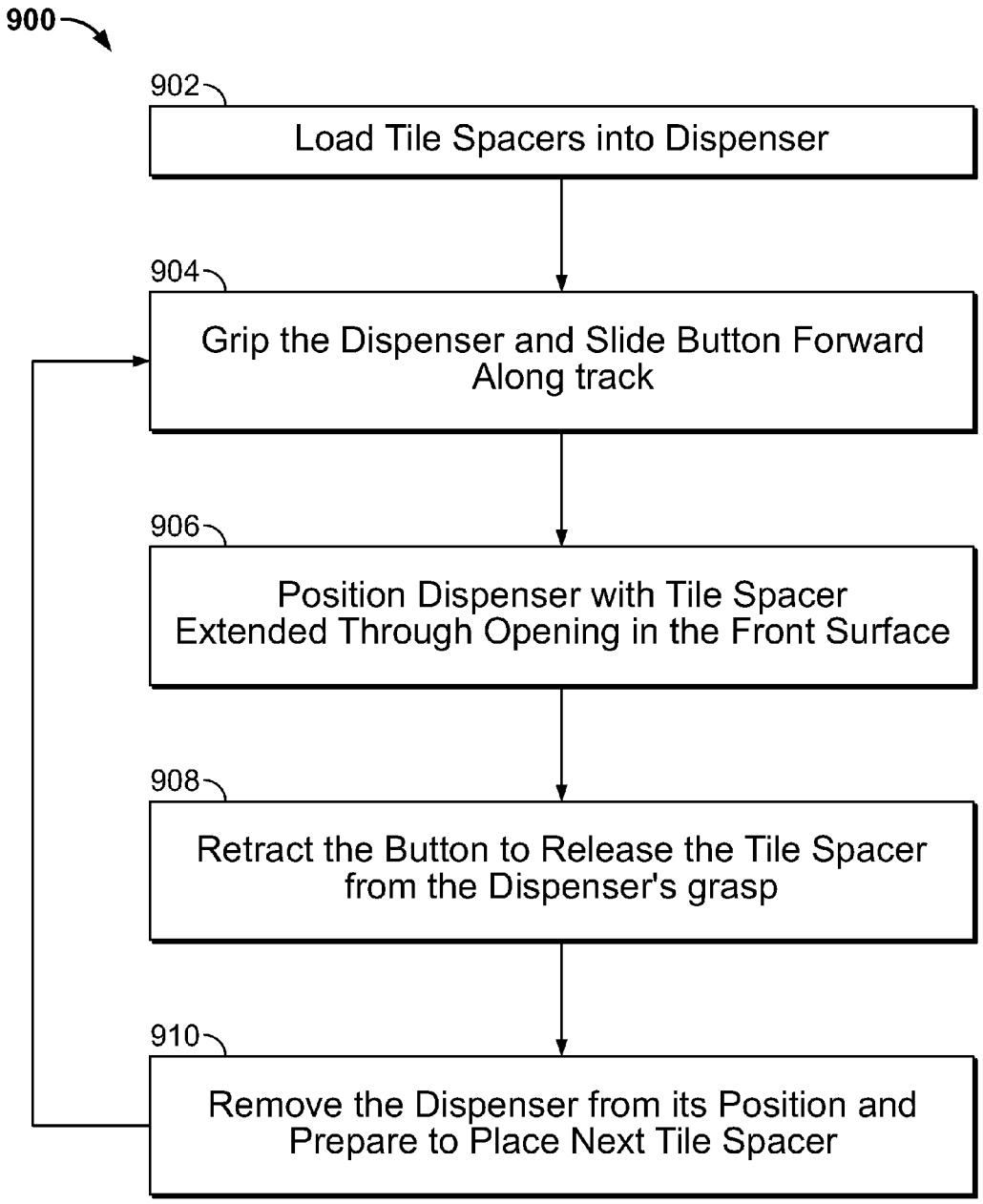
FIG. 9 is a flowchart of an example technique for dispensing tile spacers using tile spacer dispensers.

FIG. 9 is a flowchart of an example technique 900 for dispensing tile spacers using tile spacer dispensers. The technique 900 can be implemented using any of a variety of appropriate tile spacer dispenser, such as the tile spacer dispensers described in this document (e.g., dispensers 600, 704, and 800) or other appropriate dispensers.

A user can load tile spacers into a tile spacer dispenser (902). For example, a user can load a cartridge of tile spacers into a tile spacer dispenser, as described above with regard to FIGS. 3A-C and FIGS. 6A-J.

The user can grip the dispenser and slide a button forward along a track, which can cause a tile spacer to extend partway through an opening of the dispenser (904). For example, the user can slide the slide handle 706 forward so that the tile spacer 702 extends partially through the opening of the dispenser 700, as described above with regard to FIGS. 7A-C.

The user can position the dispenser at an appropriate location to which the tile spacer should be placed (706). For example, the user can move the dispenser 700 so that the tile spacer 702, while extending partway through the opening (as depicted in FIGS. 7C-D), is positioned in a gap between two adjacent tiles.

The user can retract the button to release the tile spacer from the grasp of the dispenser (908). For example, the user can slide the slide button 706 backward which can cause the tile spacer 702 to be released by the dispenser 700, as depicted in FIG. 7E.

The user can then reposition the dispenser for dispensing of the next tile spacer (910). For example, the user can slide the slide button 706 back fully and can position the dispenser 700 at a next location where a tile spacer is needed.

Figure 10A:
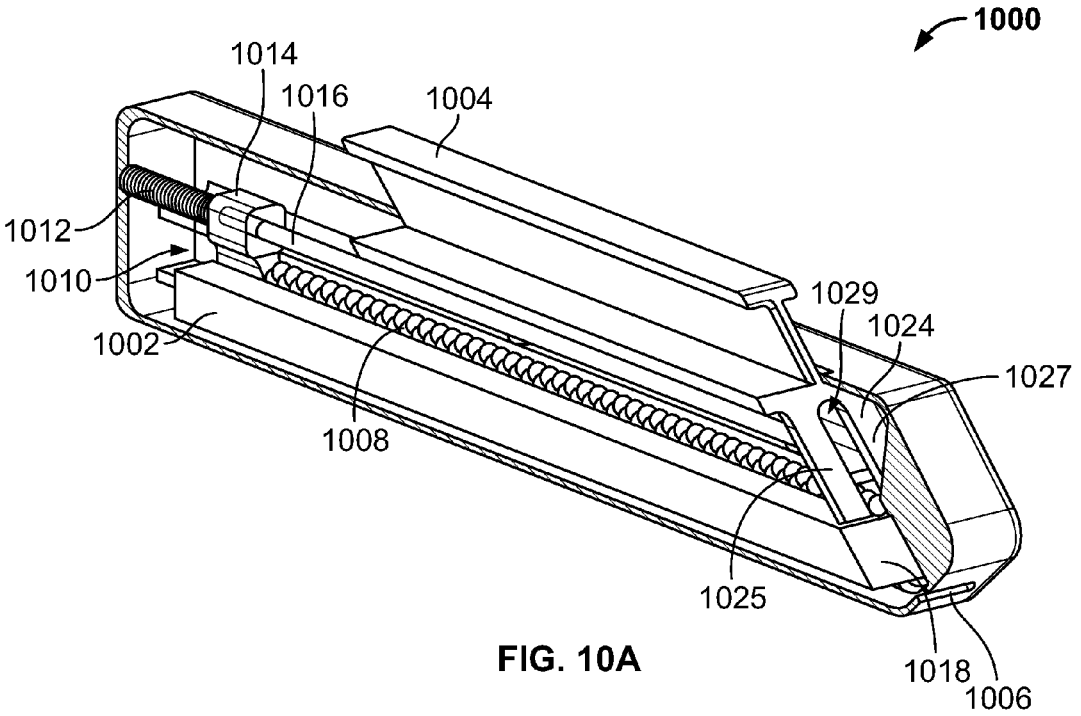
FIGS. 10A-E depict an example tile spacer dispenser and example tile spacer cartridges.
Figure 10B:
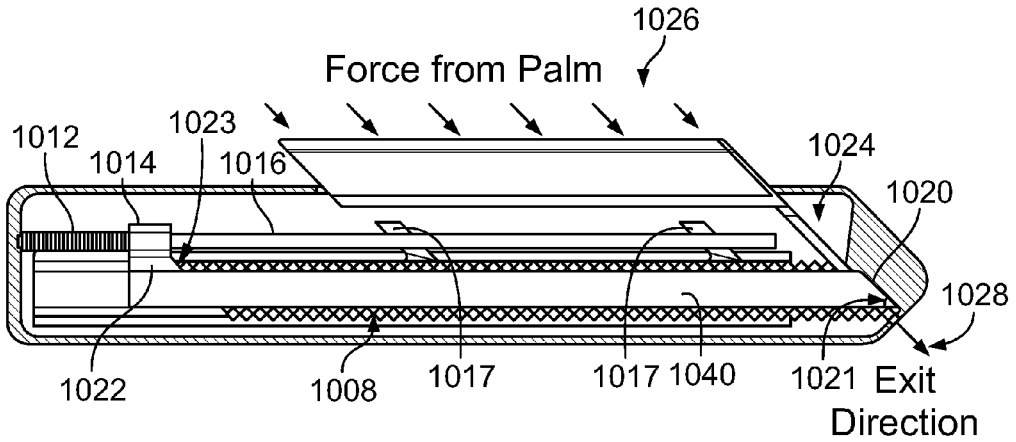

FIGS. 10A-E depict an example tile spacer dispenser 1000 and example tile spacer cartridges 1002 and 1040. In the depicted example, the tile spacer dispenser 1000 includes an example palm trigger 1004 that can be gripped/squeezed/depressed (e.g., drawn into the body of the dispenser 1000) by a user to dispense a tile spacer 1008 out of an opening 1006 at a front of the dispenser 1000. The tile spacer dispenser 1000 can store tile spacers 1008 that are properly oriented and positioned within the dispenser 1000 for dispensing. As depicted, the spacers 1008 can be stacked within a cartridge (e.g., cartridge 1002 or cartridge 1040), and a first of the tile spacers (e.g., a tile spacer at a front end of the spacers 1008) can be dispensed when the palm trigger 1004 is gripped/squeezed by the user. A forward-pressure mechanism 1010, which in this example includes a spring 1012 and a cap 1014, can be positioned between a last of the tile spacers and a rear, interior surface of the dispenser 1000 to apply forward pressure against the tile spacers 1008 so that a first (e.g., forward-most) of the tile spacers is properly positioned to be dispensed. In the depicted example, the cap 1014 can slide along a rod 1016 within the dispenser 1000. The cap 1014, or a portion of the cap (e.g., an engagement portion), can pass through an opening at a rear end of the cartridge to apply forward pressure against the tile spacers 1008. The forward-pressure mechanism 1010 can include the rear surface 1052 of the dispenser 1000 in some examples (see, e.g., FIG. 10E), and in other examples the rear surface 1052 may not be attached to the forward-pressure mechanism 1010. In some examples, one or more guides 1017 (e.g., one, two, three, or more; two guides 1017 are shown in FIG. 10B) may be included within the dispenser 1000, and the rod 1016 may extend through a void in the one or more guides 1017. In some examples, the one or more guides 1017 may provide a downward stop to the palm trigger 1004 when a user depresses the palm trigger 1004.

FIG. 10A depicts a perspective cutaway view of the example dispenser 1000. The tile spacers 1008 can be stored within a cartridge 1002 positioned within a chamber 1050 (see, e.g., FIG. 10E) within the dispenser 1000, and can be dispensed one by one as the palm trigger 1004 is squeezed/gripped/depressed by a user. The chamber 1050 can be accessible in any of a variety of ways, such as through removable (or hinged) rear surface 1052 (or surfaces) to permit access to the chamber 1050. In the depicted example, the rear surface 1052 can be removed and a new cartridge 1002 (or 1040) of spacers 1008 can be inserted into the chamber 1050 of the dispenser 1000.

In some examples, the cartridge 1002 (or 1040) is a disposable, one-time-use cartridge, and when a last of the spacers has been dispensed, the empty cartridge can be removed from the tile spacer dispenser 1000 and a new cartridge can be loaded into the dispenser 1000. The cartridge may be made out of a plastic or recyclable plastic material, or cardboard material, for example, or any other appropriate material choice. In other examples (not shown), the dispenser 1000 can provide alternative ways of replacing or accessing the cartridge, such as by including a hinged or removable top surface (or bottom surface) of the dispenser than can be opened or removed to insert a new cartridge 1002 or 1040, with appropriate modifications to the channel 1050 to receive the cartridge from above or below, for example.

In some examples, the cartridge 1002 (or 1040) can be reusable, and additional spacers 1008 can be loaded into a previously used cartridge, as by removing the rear surface 1052 of the dispenser 1000 and adding the spacers 1008 to the cartridge, or by first removing the cartridge from the dispenser 1000, adding the spacers 1008, replacing the cartridge in the chamber 1050 of the dispenser 1000, and replacing the rear surface 1052 and forward-pressure mechanism 1010. As another example, the dispenser 1000 can include a hinged rear surface (not shown) that can be opened to insert a new cartridge 1002 or 1040 of tile spacers 1008, or to load additional tile spacers 1008 into the cartridge for dispensing.

Figure 10C:
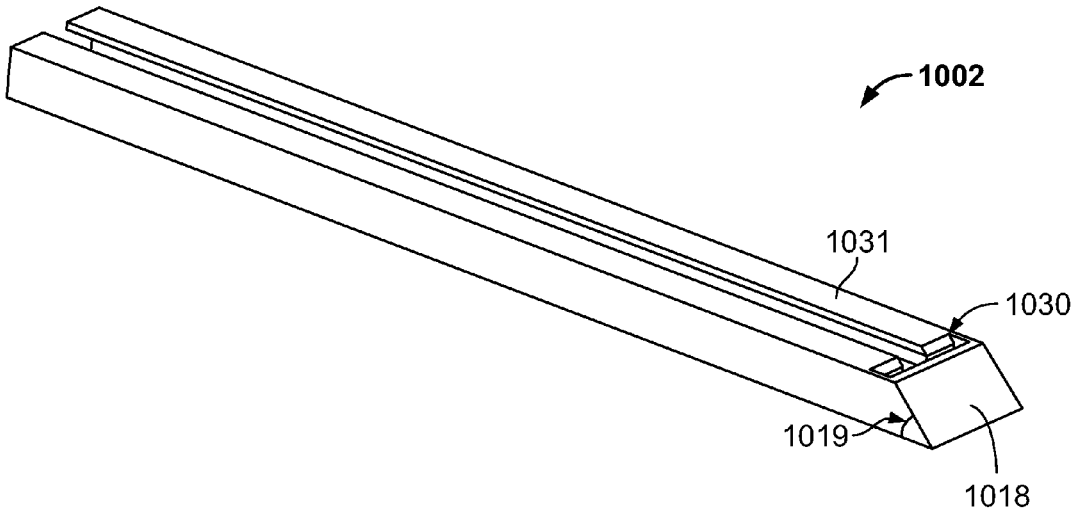
Figure 10D:
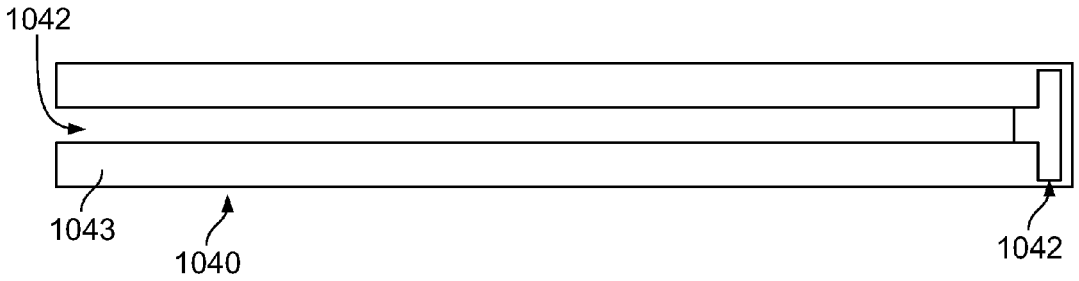
Figure 10E:
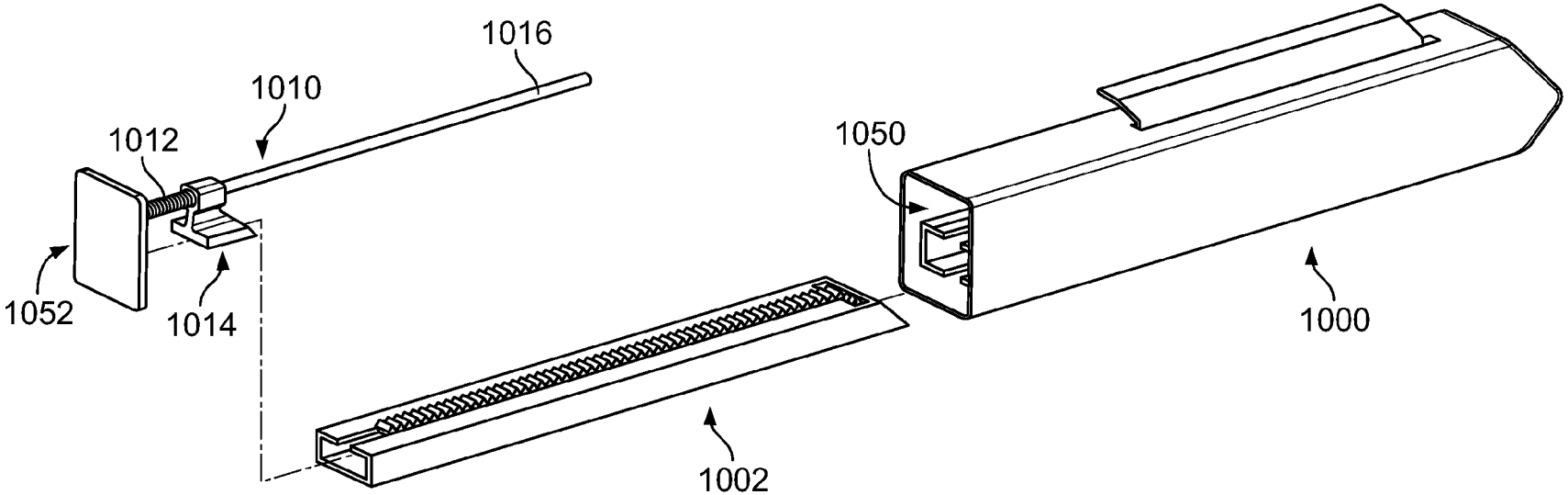

FIGS. 10C and 10D show, respectively, a perspective view of a first example cartridge 1002 and a bottom view of a second example cartridge 1040. Cartridges 1002 and 1040 are similar, but cartridge 1002 includes a solid lower surface (not shown in FIG. 10C), while cartridge 1040 includes a channel 1042 in a lower surface 1043 of the cartridge 1040. Either of cartridges 1002 or 1040 can be used with tile spacer dispenser 1000, for example. Cartridge 1002 includes an angled front surface 1018 that defines an angle 1019 between the front surface 1018 of the cartridge 1002 and the lower surface of cartridge 1002. Cartridge 1040 includes an angled front surface 1020 that defines an angle 1021 between the front surface 1020 of the cartridge 1040 and the lower surface 1043 of cartridge 1040. In some examples, the angled front surfaces 1018 and 1020 may be the same or similar, and the angles 1019 and 1021 defined by the front surfaces may be the same or similar, such as about 45 degrees in some examples. Each of the cartridges 1002 and 1040 may include a group of tile spacers that are pre-stacked and pre-oriented in a particular manner within the cartridge such that the spacers can be properly dispensed from the dispenser 1000. Referring again to FIGS. 6I and 6J, cartridge 604 can be used with dispenser 1000 in some implementations. In some examples, chamber 1050 of dispenser 1000 can be modified to receive cartridge 604, for example. Cartridge 604 may be oriented as shown in FIG. 6J, and loaded into the chamber 1050 (or an appropriately modified chamber 1050 in some examples) of the dispenser 1000.

The dispenser 1000 can additionally include an example tile spacer retention mechanism (not shown in FIG. 10A for simplicity) that can retain the tile spacer being dispensed when the tile spacer is partway through the opening 1006. One example of the tile spacer retention mechanism includes a rubber coating (or a coating of another compressible or flexible material) located on a top-side and a bottom-side of the opening 1006. As another example, the tile spacer retention mechanism may be similar to the retention mechanisms 116*a* and 116*b* of FIG. 1, such as flexible pieces of material (e.g., rubber, brush bristles) that are affixed to the dispenser adjacent to top and bottom sides the opening 1006 and which may extend inward and impede upon the vertical spacing of the opening 1006, in some examples (see, e.g., discussion above with reference to FIG. 1). As yet other examples, the dispenser 1000 can include a tile spacer retention mechanism to prevent the spacers 1008 from falling out the opening 1006 that is the same or similar to other retention mechanisms discussed herein (e.g., mechanisms 208, 412). In various implementations, the tile spacer retention mechanism may be at the opening 1006, may extend outward from the opening 1006, or may be interior of the dispenser 1000 and inward of the opening 1006.

In some examples, the retention mechanism can retain a tile spacer 1008 that partially extends through the opening 1006 so that, once the tile spacer has been moved into such a position through a user gripping/squeezing/depressing the palm trigger 1004, the tile spacer 1008 does not fall out of the opening 1006, or fall back into the opening 1006, regardless of the angle of the dispenser 1000 (e.g., downward angle so that the tile spacer extends vertically toward the ground, upward angle so that the tile spacer extends vertically toward a ceiling surface, or angles between the upward and downward angles) without further movement of the palm trigger 1004 by the user. Other implementations of the tile spacer retention mechanisms are also possible. For example, retention mechanisms can be positioned additionally and/or alternatively at the right-side of the opening 1006 and left-side of the opening 1006, or adjacent to the right and left sides of the opening 1006, and can impede upon the horizontal spacing of the opening 1006. Other implementations are also possible.

FIGS. 10A and 10B depict views of the tile spacer dispenser 1000 and an example dispensing mechanism 1024 of the dispenser 1000 for dispensing a first tile spacer from the cartridge (e.g., 1002 or 1040) of the dispenser 1000. The example dispensing mechanism 1024 is similar to the plunger 220 of FIG. 2, and in this example is integral with the palm trigger 1004. The dispensing mechanism 1024 extends downward and forward from the palm trigger 1004 at an angle. The dispensing mechanism 1024 can contact a tile spacer 1008 and apply a downward and forward force to the tile spacer 1008 when the palm trigger 1004 is gripped/squeezed/depressed by a user. In response to a user depressing the palm trigger 1004, the dispensing mechanism extends downward and forward into the cartridge 1002 through an opening 1030 in a top surface 1031 (see, e.g., FIG. 10C) of the cartridge 1002 and pushes the tile spacer 1008 downward and forward out of the an opening (not shown) in the bottom surface of the cartridge 1002 (e.g., which opening may be the same or similar to opening 1042 shown in FIG. 10D in the bottom surface 1043 of cartridge 1040), and out of the opening 1006 of the dispenser 1000.

In the depicted example, the dispensing mechanism includes a first leg 1025 and a second leg 1027 that each may engage a portion (e.g., a left portion or left arm and a right portion or right arm) of a tile spacer 1008. The example dispensing mechanism 1024 includes a void 1029, disposed between the first leg 1025 and the second leg 1027, where at least a portion of the void 1029 (e.g., a width of the void) is shaped and dimensioned to fit a portion (e.g., an upper portion or upper arm) of the tile spacer 1008 so that, as the tile spacer 1008 is moved by the dispensing mechanism 1024, the tile spacer 1008 does not unexpectedly change alignment or orientation.

The dispensing mechanism 1024, and the first leg 1025 and second leg 1027 of the dispensing mechanism 1024, may define an angle between the dispensing mechanism 1024 (or between the first leg 1025 and/or the second leg 1027) and the top surface 1031 of the cartridge 1002, where the angle is the same or similar as the angle 1019, described above with reference to FIG. 10C. Similarly, the dispensing mechanism 1024, and the first leg 1025 and second leg 1027 of the dispensing mechanism 1024, may define an angle between the dispensing mechanism 1024 (or between the first leg 1025 and/or the second leg 1027) and the bottom surface of the cartridge 1002, where the angle is the same or similar as the angle 1019.

In various examples, the spring 1012 may be attached at a first end of the spring to the rear panel 1052 of the dispenser, and at a second end of the spring to the cap 1014. An engagement portion 1022 of the cap 1014 may be configured to contact a rear-most tile spacer in the group of tile spacers 1008 within the cartridge. The engagement portion 1022 of the cap 1014, in this example, includes an angled front surface 1023 contacts the rear-most spacer in the group of tile spacers 1008 within the cartridge. In some examples, an angle defined by the angled front surface 1023 of the cap 1014 matches the angle (1019 or 1021) defined by front surface 1018 or 1020 of the cartridge 1002 or 1040, respectively. The cap 1014 may include a void through which the rod 1016 passes, and the cap 1014 may slide along the rod 1016 (e.g., based on forward pressure applied by the spring 1012) to apply forward pressure against the tile spacers 1008 and keep the spacers 1008 aligned and oriented for dispensing from the dispenser 1000. The tile spacers 1008 can be the same or similar to other tile spacers discussed herein above. In some examples, the front surface of the engagement portion 1022 may not be angled.

The openings in the top and bottom surfaces, and the opening at the rear end of the tile spacer cartridge (e.g., cartridge 1002 or 1040) can initially be covered by an easily breakable/removable material (e.g., plastic wrap, paper) that can keep the tile spacers 1008 from falling out of or otherwise passing through the rear end opening and the top and bottom openings until removed/broken. For example, a user can place a cartridge 1002 in the dispenser 1000 with rear, top and bottom surface openings being covered and can puncture the material covering at the rear end of the cartridge with the engagement portion 1022 of the cap 1014 (described further below), and can puncture the material covering the top and bottom openings by simply squeezing/gripping the palm trigger 1004 so as to drive the dispensing mechanism 1024 or legs thereof through the material covering the top opening 1030 and the tile spacer 1008 (or dispensing mechanism 1024 or legs thereof) through the material covering the bottom opening. The user can then proceed to dispense the tile spacer 1008 and the other tiles spacers in the cartridge 1002 until all of the tile spacers 1008 have been dispensed and the cartridge 1002 is ready to be replaced. Alternatively, the cartridge (e.g., cartridge 1002 or 1040) can include two or more tabs (e.g., the same or similar to tabs 602, see FIGS. 6I, 6J) instead of the breakable/removable material at the rear of the cartridge in some examples, where the two or more tabs (e.g., three tabs) prevent the spacers from falling out of the rear end of the cartridge before the cartridge is loaded into the dispenser 1000.

When a user is ready to place a tile spacer 1008, the user may apply a downward, or downward and forward force 1026 (see, e.g., FIG. 10B) by squeezing/gripping/depressing the palm trigger 1004 to depress the palm trigger 1004 a first distance into the body of the dispenser 1000, which may cause the dispensing mechanism 1024 to move forward and downward into the cartridge (e.g., cartridge 1002 or 1040) and physically contact and push the tile spacer 1008 part way out of the cartridge through the opening 1006 in an exit direction 1028 (see, e.g., FIG. 10B). The tile spacer 1008 can physically contact the tile spacer retention mechanism, which, through friction and the physical contact, can retain the tile spacer 1008 in that position and can keep the tile spacer 1008 from falling out of the opening 1006. For example, if the dispenser 1000 with the tile spacer 1008 partially extending out of the opening 1006 were to be oriented by a user so that the opening 1006 is facing (parallel to) the ground and an outward gravitational force is exerted on the tile spacer 1008, the retention mechanism can retain the tile spacer 1008 in its position and keep the tile spacer 1008 from falling out of the opening 1006. Additionally, when the tile spacer 1008 reaches and physically contacts the retention mechanism, a greater level of resistance may be encountered by the dispensing mechanism 1024 due to a friction force between the retention mechanism and the spacer 1008. This greater level of resistance can be felt by the user through the palm trigger 1004, and may inform the user that a greater level of force may be required at the palm trigger 1004 when the tile spacer 1008 reaches the retention mechanism to fully dispense the tile space 1008 from the dispenser 1000. This resistance can provide haptic feedback to the user as to when the tile spacer 1008 has reached the opening 1006, which can provide a user with an indication as to when he/she should move or position the dispenser 1000 to a location where the tile spacer 1008 is intended to be dispensed.

When the user is ready to fully dispense the tile spacer 1008 from the dispenser 1000, the user can apply additional force 1026 at the palm trigger 1004, so that the palm trigger 1004 is further depressed into the body of the dispenser 1000. The dispensing mechanism 1024 may push the tile spacer 1008 past the retention mechanism and out of the opening 1006. For example, the user may place or (locate in a proper location) the tile spacer 1008 as it is partially extended through the opening 1006, in a gap between two adjacent tiles and then may squeeze/grip/depress the palm trigger 1004 to fully dispense the tile spacer 1008 into the gap between the tiles.

The user can release the palm trigger 1004 from its depressed state to retract the dispensing mechanism 1024, which may cause the dispensing mechanism 1024 and the palm trigger 1003 to return to their starting positions. In various examples, the palm trigger 1004 and dispensing mechanism 1024 may return to their starting positions automatically (e.g., through the use of internal mechanisms that have built up potential energy when the palm trigger 1004 was gripped/squeezed/depressed, such as one or more springs or bows) or manually (e.g., by the user extending the palm trigger 1004 outward and away from the body of the dispenser 1000). For example, as the palm trigger 1004 returns to its starting position, the palm trigger 1004 can draw the dispensing mechanism 1024 upward or upward and back to its starting position. As the dispensing mechanism 1024 is drawn upward or upward and back, for example, the forward pressure exerted by the spring 1012 on the cap 1014, and the forward pressure exerted by the front surface 1023 of the engagement portion 1022 of the cap 1014 against the tile spacers 1008, may cause a next spacer to be moved into position (e.g., a first or forward position) within the cartridge for dispensing. In this manner, a next spacer in the group of spacers 1008 may be properly positioned within the cartridge to be dispensed the next time the user applies force 1026 at the palm trigger 1004.

As the tile spacers 1008 are pressed forward by the cap 1014, and by the angled front surface 1023 of the engagement portion 1022 of the cap, and in conjunction with the angled front surface 1018 or 1020 of the cartridge 1002 or 1040, respectively, the tile spacers may be held within the cartridge at an angle. In some examples, the angles of the front surface of the cartridge, the front surface 1023 of the engagement portion 1022 or the cap 1014, and the angle that the tile spacers 1008 are held within the cartridge may be about 45 degrees (e.g., with respect to a lower or bottom surface of the tile spacer dispenser 1000). In other examples, the angles of the above-mentioned components may be varied. For example, the dispenser 1000 and cartridge may be configured such that the angles of the above-mentioned components are within a range of about 44-46 degrees, or within a range of about 43-47 degrees, or within a range of about 42-48 degrees, or within a range of about 41-49 degrees, or within a range of about 40-50 degrees, or within a range of about 35-55 degrees, or within a range of about 30-60 degrees, or within a range of about 25-65 degrees.

In some examples, the tile spacer cartridge can include internal surfaces within the cartridge that are sized and located so as to keep tile spacers within the cartridge in a particular orientation. For example, a cartridge may include internal surfaces that extend into the space between adjacent portions or arms of the 'X' shaped tile spacers when oriented at an angle (e.g., at about a 45 degree angle) and in a stacked configuration. The example internal surfaces can be positioned in a variety of ways (e.g., in opposite corners of the interior of the cartridge) and can extend the length of the cartridge. Other configurations, orientations of tile spacers, and other internal surfaces are also possible.

FIGS. 11A-D depict an example of a user 1100 dispensing a tile spacer 1102 using an example tile spacer dispenser 1104. In the depicted example, the dispenser 1104 has a palm trigger 1106 that the user 1100 can grip or depress to partially extend the tile spacer 1102 while the tile spacer 1102 is still being retained by the dispenser 1104, and that will release/expel the tile spacer 1102 when the palm trigger 1106 is fully depressed, for example. The dispenser 1104 can be similar to the tile spacer dispenser 1000 described above with regard to FIG. 10. The example depicted in FIGS. 11A-D, and/or variations thereof, can be performed using other tile spacer dispensers, such as the dispensers 100, 200, 300, 400, 700 and/or other appropriate tile spacer dispensers.

Figure 11A:
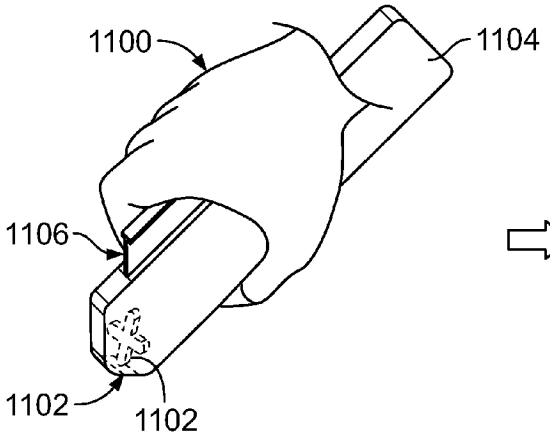
FIGS. 11A-D depict an example of a user dispensing a tile spacer using an example tile spacer dispenser.
Figure 11B:
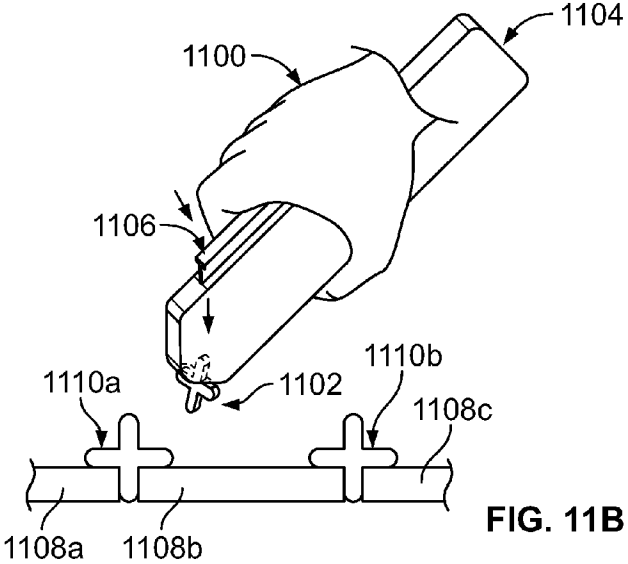

Referring to FIG. 11A, the palm trigger 1106 and the dispensing mechanism are retracted and in a starting position, and the tile spacer 1102 is in a starting position within the dispenser 1104 and with a starting orientation. Referring to FIG. 11B, the user 1100 has partially depressed the palm trigger 1106, which has caused the tile spacer 1102 to be pushed downward and forward by the dispensing mechanism so that the tile spacer 1102 is partially protruding from an opening at the front of the dispenser 1104. The tile spacer 1102 may be retained by the retaining mechanism (which in this example may be a rubber or flexible coating on one or more surfaces (e.g., top and bottom) of the opening), which may prevent the tile spacer 1102 from falling out of the opening (e.g., opening 1006, see FIG. 10). Two other spacers 1110*a* and 1110*b* are shown as having previously been placed in FIG. 11B. Spacer 1110*a* separates tile 1108*a* from tile 1108*b*, for example so that grout may be dispensed in the space between the tiles 1108*a*, 1108*b*; similarly, spacer 1110*b* separates tile 1108*b* from tile 1108*c*, for example so that grout may be dispensed in the space between the tiles 1108*b*, 1108*c*. In the depicted example, the spacers 1110*a* and 1110*b* may define spaces for grout lines that run in a first direction, and spacer 1102 may be placed to define a space for a grout line that runs in a second direction, perpendicular to the first direction. For example, if spacers 1110*a* and 1110*b* define spaces for vertical grout lines, spacer 1102 may define space for a horizontal grout line, which is why spacer 1102 is placed at an orientation perpendicular to the orientation of spacers 1110*a* and 1110*b*. In FIG. 11B, the user 1100 is holding the dispenser 1104 above the tiles. The user 1100 can position the dispenser 1104 at or near a location where the tile space 1102 is intended to be placed. For instance, the dispenser 1104 can be positioned above a gap between the tile 1108*b* and an adjacent tile (not shown) that is located behind the tile 1108*b*.

Figure 11C:
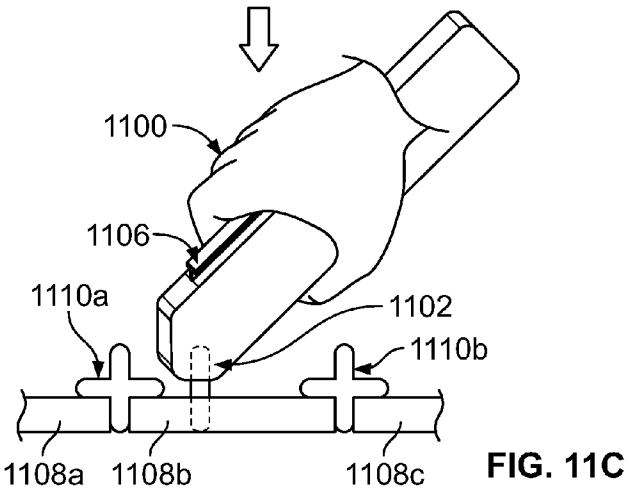

Referring now to FIG. 11C, the user 1100 positioned the dispenser 1104 at a location and with an orientation appropriate for dispensing spacer 1102. Spacer 1102 remains partially extended from the opening of the dispenser 1104, yet still retained by the retaining mechanism and partially within the dispenser 1104. In this manner, the dispenser 1104 and the protruding portion of the spacer 1102 may be correctly positioned by the user, and the partial protrusion of the spacer 1102 from the dispenser 1104 may provide visual assistance to the user 1100 in making an accurate tile placement.

In FIG. 11C, the user 1100 has lowered the tile spacer 1102 into the gap between the tile 1108*b* and the adjacent tile (not visible) located behind the tile 1108*b*. While in such a position, the user 1100 may adjust the positioning of the tile 1108*b* and/or the adjacent tile so that they contact the tile spacer 1102, which can ensure that uniform gaps between the tiles are formed and, when grout is applied, that the grout lines are uniform as well. The user 1100 can position the tile spacer 1102 while keeping the palm trigger 1106 in the partially depressed position. When the user 1100 is satisfied with the positioning of the spacer 1102, the user 1100 can fully depress the palm trigger 1106, which may cause the dispensing mechanism of the dispenser 1104 to push the spacer 1102 past the retention mechanism of the dispenser and out of the opening of the dispenser 1104 to place the spacer 1102.

Figure 11D:
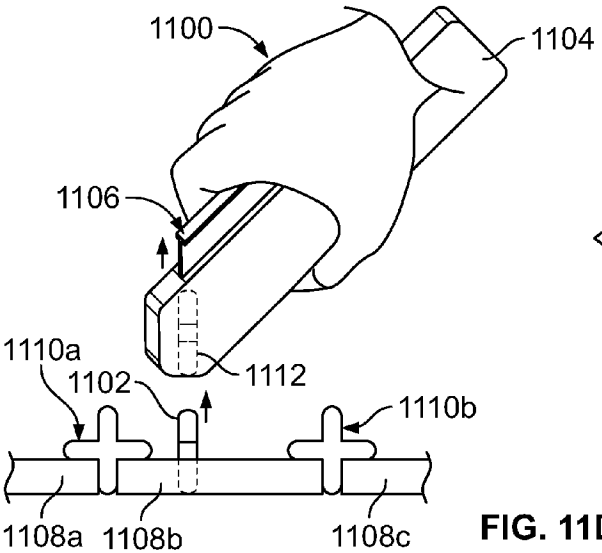

Referring to FIG. 11D, the user 1100 has placed the spacer 1102, and lifted the dispenser 1104 upward from the placement position. The user 1100 can release pressure on the palm trigger 1104, which can cause the palm trigger 1104 and the dispensing mechanism to return to their starting positions. The forward-pressure mechanism 1010 may urge a next spacer 1112 into the forward-most position within the cartridge so that the next spacer 1112 is in position within the cartridge for placing, and the dispenser 1104 may be ready to dispense the next tile spacer 1112. The tile spacer 1102 can remain in its position between the tile 1108*b* and the adjacent tile (not shown).

Figure 12:
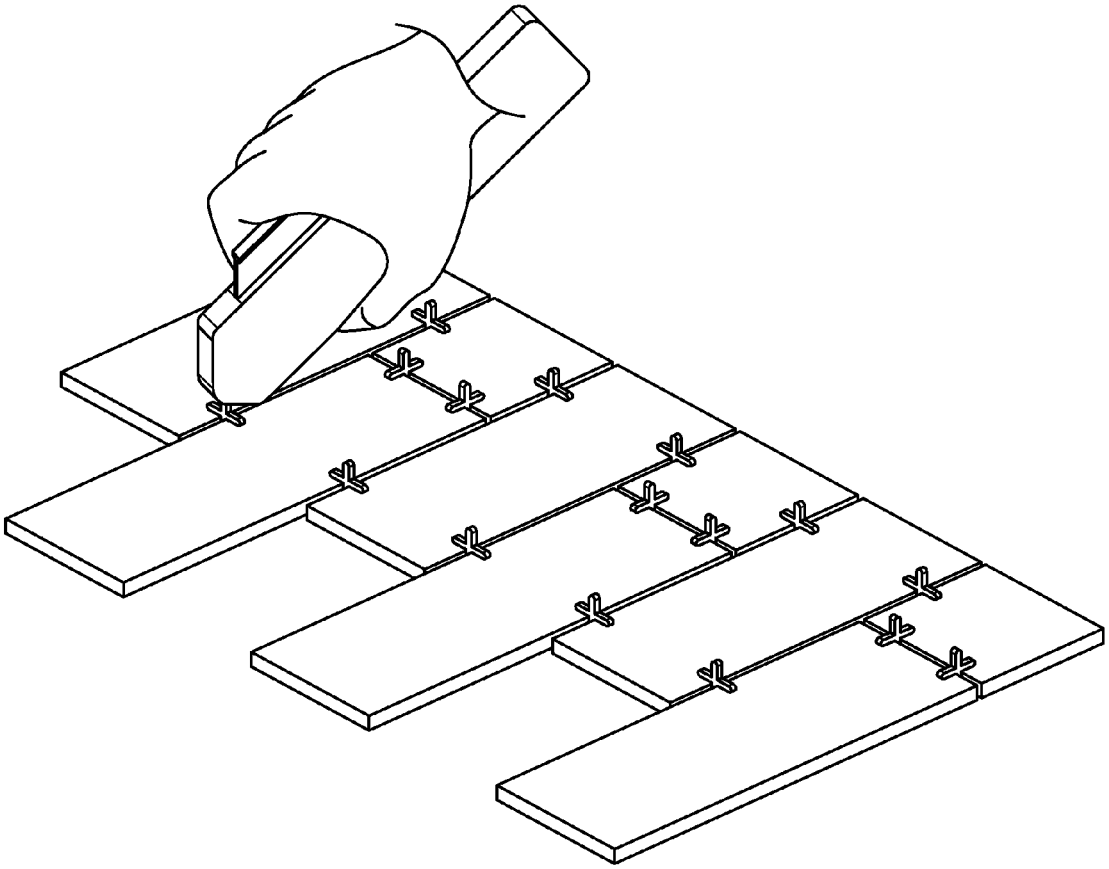
FIG. 12 depicts an example of a user dispensing a tile spacer using an example tile spacer dispenser.

FIG. 12 is a perspective view of various tiles, already-placed tile spacers, and a user placing a tile spacer using an example tile spacer dispenser. The tile spacer dispenser may correspond to the dispenser 1100 of FIG. 10 or 1104 of FIG. 11 in some examples, or in other examples may correspond to any of the dispensers discussed herein above.

The above description provides examples of some implementations. Other implementations that are not explicitly described above are also possible, such as implementations based on modifications and/or variations of the features described above. For example, the techniques described above may be implemented in different orders, with the inclusion of one or more additional steps, and/or with the exclusion of one or more of the identified steps. Additionally, the steps and techniques described above as being performed by some tile spacer dispensers may alternatively, or additionally, be performed by other tile spacer dispensers that are described above or other tile spacer dispensers that are not explicitly described. Similarly, the systems, devices, and apparatuses may include one or more additional features, may exclude one or more of the identified features, and/or may include the identified features combined in a different way than presented above. Features that are described as singular may be implemented as a plurality of such features. Likewise, features that are described as a plurality may be implemented as singular instances of such features. The drawings are intended to be illustrative and may not precisely depict some implementations. Variations in sizing, placement, shapes, angles, and/or the positioning of features relative to each other are possible.

What is claimed is:

1. A handheld device for placing tile spacers, the device comprising:

a body that is sized and shaped for a user to hold;

a cartridge enclosed within the body that stores a plurality of tile spacers, wherein the cartridge includes a front surface and a lower surface, and wherein the front surface defines an angle of about 45 degrees with the lower surface;

an input mechanism affixed to the body that is moveable based on application of force by the user;

an opening in the body that is sized and shaped for tile spacers; and a dispensing mechanism contained within the body that, in response to an application of force to the input mechanism by the user, causes a particular tile spacer from the plurality of tile spacers to be moved from the cartridge and out of the opening.

2. The handheld device of claim 1, further comprising:

a retention mechanism disposed in a proximity to the opening, the retention mechanism configured to retain the particular tile spacer when it is partially extended out of the opening.

3. The handheld device of claim 1, wherein the input mechanism comprises a palm trigger.

4. The handheld device of claim 1, wherein the input mechanism comprises a button.

5. The handheld device of claim 1, wherein the input mechanism comprises a handle.

6. The handheld device of claim 1, wherein the input mechanism comprises an element that is slideable along a track.

7. The handheld device of claim 1, wherein the cartridge comprises a removable cartridge that contains the plurality of tile spacers.

8. The handheld device of claim 1, wherein a forward end of the body includes a first angled surface of the body and a second angled surface of the body, and wherein the opening is disposed on the first angled surface of the body.

9. The handheld device of claim 1, further comprising a forward-pressure mechanism that includes a spring, wherein the forward-pressure mechanism imparts a forward pressure on the plurality of tile spacers.

10. The handheld device of claim 9, wherein the forward-pressure mechanism includes an angled surface, and wherein the angled surface imparts the forward pressure on a rear-most tile spacer of the plurality of tile spacers.

11. The handheld device of claim 10, wherein the angled surface of the forward-pressure mechanism imparts the forward pressure on the rear-most tile spacer of the plurality of tile spacers from a location generally below an upper surface of the cartridge.

12. The handheld device of claim 1, further comprising a chamber within the body, the chamber configured to retain the cartridge within the body.

13. The handheld device of claim 1, wherein the cartridge includes a first opening in an upper surface of the cartridge and a second opening in the lower surface the cartridge.

14. The handheld device of claim 1, wherein each of the first opening in the upper surface of the cartridge and the second opening in the lower surface the cartridge are covered by a removable or breakable material.

15. The handheld device of claim 1, wherein the dispensing mechanism includes a first leg and a second leg.

16. The handheld device of claim 15, wherein the dispensing mechanism includes a void disposed between the first leg and the second leg, wherein at least a portion of the void is sized to fit a portion of a tile spacer of the plurality of tile spacers.

17. The handheld device of claim 1, wherein the dispensing mechanism is integral with the input mechanism.

18. The handheld device of claim 1, wherein the lower surface of the cartridge defines a channel in the lower surface of the cartridge.

* * * * *